US009427761B2

(12) United States Patent
Yamada et al.

(10) Patent No.: US 9,427,761 B2
(45) Date of Patent: Aug. 30, 2016

(54) NOZZLE CAP-EQUIPPED DISCHARGE CONTAINER

(71) Applicant: Kao Corporation, Chuo-ku (JP)

(72) Inventors: Takashi Yamada, Machida (JP); Yoshinori Inagawa, Chiba (JP)

(73) Assignee: Kao Corporation, Chuo-ku (JP)

( * ) Notice: Subject to any disclaimer, the term of this patent is extended or adjusted under 35 U.S.C. 154(b) by 0 days.

(21) Appl. No.: 14/653,735

(22) PCT Filed: Dec. 16, 2013

(86) PCT No.: PCT/JP2013/083622

§ 371 (c)(1),
(2) Date: Jun. 18, 2015

(87) PCT Pub. No.: WO2014/098029

PCT Pub. Date: Jun. 26, 2014

(65) Prior Publication Data

US 2015/0328652 A1 Nov. 19, 2015

(30) Foreign Application Priority Data

Dec. 18, 2012 (JP) ..... 2012-275933
Dec. 18, 2012 (JP) ..... 2012-275934
Dec. 18, 2012 (JP) ..... 2012-275935
Dec. 25, 2012 (JP) ..... 2012-280885

(51) Int. Cl.
*B05B 11/04* (2006.01)
*B05B 7/00* (2006.01)
*B05B 7/04* (2006.01)

(52) U.S. Cl.
CPC ..... *B05B 11/047* (2013.01); *B05B 7/0037* (2013.01); *B05B 7/0062* (2013.01); *B05B 7/0018* (2013.01); *B05B 7/04* (2013.01)

(58) Field of Classification Search
CPC . B05B 11/047; B05B 7/0037; B05B 7/0062; B05B 7/0018; B05B 7/04
See application file for complete search history.

(56) References Cited

U.S. PATENT DOCUMENTS 4,018,364 A * 4/1977 Wright ..... A45D 27/02 222/190
5,219,102 A * 6/1993 Wright ..... B05B 11/043 222/190

(Continued)

FOREIGN PATENT DOCUMENTS

CN 101668508 A 3/2010
CN 102639404 A 8/2012

(Continued)

OTHER PUBLICATIONS

International Search Report Issued Mar. 18, 2014 in PCT/JP2013/083622 Filed Dec. 16, 2013.

(Continued)

*Primary Examiner* — Frederick C Nicolas
(74) *Attorney, Agent, or Firm* — Oblon, McClelland, Maier & Neustadt, L.L.P

(57) ABSTRACT

A nozzle cap-equipped discharge container (10) includes a container body (11) that is to contain content liquid, and a nozzle cap (12) that is mounted on a mouth neck section (11*a*) of the container body (11) and includes a discharge section (13) discharging the content liquid fed by the pressurization of the inside of the container body (11). The nozzle cap (12) includes a longitudinal discharge flow passage (16) that sends upward the content liquid fed from the container body (11), and a tip-side discharge flow passage (17) that allows the longitudinal discharge flow passage (16) and the discharge section (13) to communicate with each other. The nozzle cap (12) includes a body part (12*a*) and a lid part (12*b*), and the body part (12*a*) includes the longitudinal discharge flow passage (16) therein. The lid part (12*b*) forms the upper part (20*a*) of a region including a portion directly above the longitudinal discharge flow passage (16), and the tip-side discharge flow passage (17) includes a flow passage that is formed by the body part (12*a*) and the lid part (12*b*).

29 Claims, 3 Drawing Sheets

(56) References Cited

U.S. PATENT DOCUMENTS

| | | | | |
|---|---|---|---|---|
| 5,289,952 | A | 3/1994 | Gueret | |
| 8,430,107 | B2 * | 4/2013 | Huang | B05B 7/0037 132/112 |
| 9,004,318 | B2 * | 4/2015 | Kodama | B05B 7/0037 222/145.5 |
| 2006/0243825 | A1 | 11/2006 | Laidler et al. | |
| 2007/0164132 | A1 | 7/2007 | Laidler et al. | |

FOREIGN PATENT DOCUMENTS

| | | | |
|---|---|---|---|
| JP | 52 67607 | U | 5/1977 |
| JP | 52 93914 | U | 7/1977 |
| JP | 53 140114 | U | 11/1978 |
| JP | 59 168355 | U | 11/1984 |
| JP | 60 204471 | | 10/1985 |
| JP | 6 211261 | | 8/1994 |
| JP | 08-198295 | A | 8/1996 |
| JP | 09-156659 | A | 6/1997 |
| JP | 10 16998 | | 1/1998 |
| JP | 2934145 | | 8/1999 |
| JP | 2000 117162 | | 4/2000 |
| JP | 2000 219254 | | 8/2000 |
| JP | 2003 515443 | | 5/2003 |
| JP | 2004 531430 | | 10/2004 |
| JP | 3761140 | | 3/2006 |
| JP | 2006 517862 | | 8/2006 |
| JP | 4387107 | | 12/2009 |
| JP | 2012 1242 | | 1/2012 |
| JP | 2012 232778 | | 11/2012 |
| JP | 2013 514832 | | 5/2013 |
| WO | 01 39894 | | 6/2001 |
| WO | 02 074441 | | 9/2002 |
| WO | 2004 073873 | | 9/2004 |
| WO | 2011 075640 | | 6/2011 |

OTHER PUBLICATIONS

International Preliminary Report on Patentability and Written Opinion issued on Jul. 2, 2015 in PCT/JP2013/083622 filed on Dec. 16, 2013.

* cited by examiner

NOZZLE CAP-EQUIPPED DISCHARGE CONTAINER

CROSS REFERENCE TO RELATED APPLICATION

This application is a 371 of PCT/JP2013/083622, filed on Dec. 16, 2013, and claims priority to the following Japanese Patent applications: 2012-275934, filed on Dec. 18, 2012; 2012-275933, filed on Dec. 18, 2012; and 2012-280885, filed on Dec. 25, 2012.

TECHNICAL FIELD

The present invention relates to a nozzle cap-equipped discharge container, and particularly, to a nozzle cap-equipped discharge container including a container body, that is to contain content liquid, and a nozzle cap that is mounted on a mouth neck section of the container body and includes a discharge nozzle portion.

BACKGROUND ART

As a nozzle cap-equipped discharge container including a container body, that is to contain content liquid, and a nozzle cap that includes a discharge nozzle portion, for example, a squeeze foamer container or a squeeze-type double release container is adapted to send content liquid to a discharge nozzle portion and to discharge the content liquid from a discharge opening, which is formed at the tip of the discharge nozzle, in the form of foam or spray by the pressurization of the inside of a container body when a user grasps and presses the container body.

In the nozzle cap-equipped discharge container that sends content liquid to the discharge nozzle portion and discharges the content liquid by the pressurization of the inside of the container body, for example, a valve mechanism, which opens and closes an outside air intake port through which the outside air is taken into the container body due to negative pressure generated in the container body when the pressing of the container body is released, and a porous member, which foams content liquid while mixing the content liquid with air, need to be mounted outside or inside a longitudinal direction flow passage that is disposed inside the mouth neck section of the container body. For this reason, the structure of a nozzle cap and a step of assembling the nozzle cap become complicated and the height of the nozzle cap protruding from the mouth neck section of the container body is increased (for example, see Patent Literatures 1 and 2).

Further, in the nozzle cap-equipped discharge container that sends content liquid to the discharge nozzle portion and discharges the content liquid by the pressurization of the inside of the container body, for example, the outside air is taken into the container body through the outside air intake port due to negative pressure generated in the container body when the pressing of the container body is released. Accordingly, the container body, which has been deformed and reduced in volume, can return to an original shape. Furthermore, the outside air intake port through which the outside air is taken into the container body is adapted to be opened and closed by a valve mechanism to prevent the air, which is present in the container body, from flowing out of the container body through the outside air intake port, for example, when the container body is pressed (for example, see Patent Literatures 1 and 2).

For example, a squeeze foamer container is known as a foam discharge container that foams content liquid while mixing the content liquid with air and discharges the content liquid from a discharge nozzle portion in the form of foam (for example, see Patent Literatures 1 and 2). A container body of the squeeze foamer container is deformed and reduced in volume by an operation for grasping and squeezing (an operation for pressing) a bottle-shaped container body having flexibility. In this case, the squeeze foamer container sends air and the content liquid, which are contained in the container body, to a longitudinal discharge flow passage of a nozzle cap including a discharge nozzle portion, foams the air and the content liquid by making the air and the content liquid pass through a porous member that uses mesh or the like and is mounted in the longitudinal discharge flow passage, and discharges the air and the content liquid from the discharge nozzle portion in the form of foam.

Further, in the squeeze foamer container, a gas-liquid mixing chamber, which mixes the content liquid with air, is provided below a portion of the longitudinal discharge flow passage on which the porous member is mounted; the content liquid, which is fed from the container body through a liquid flow passage, is mixed with air, which is fed from the container body through an air flow passage, in the gas-liquid mixing chamber; and the mixture of the content liquid and the air is foamed by passing through the porous member.

CITATION LIST

Patent Literature

[Patent Literature 1] JP 2934145 B1
[Patent Literature 2] JP 2004-531430 W
[Patent Literature 3] JP 2012-1242 A

SUMMARY OF INVENTION

The invention provides a nozzle cap-equipped discharge container including: a container body that is to contain content liquid; and a nozzle cap that is mounted on a mouth neck section of the container body and includes a discharge section discharging the content liquid fed by the pressurization of the inside of the container body. The nozzle cap includes a longitudinal discharge flow passage that sends upward the content liquid fed from the container body, and a tip-side discharge flow passage that allows the longitudinal discharge flow passage and the discharge section to communicate with each other. The nozzle cap includes a body part and a lid part, and the body part includes the longitudinal discharge flow passage therein. The lid part forms the upper part of a region including a portion directly above the longitudinal discharge flow passage, and the tip-side discharge flow passage includes a flow passage that is formed by the body part and the lid part.

DESCRIPTION OF EMBODIMENTS

Figure 1:
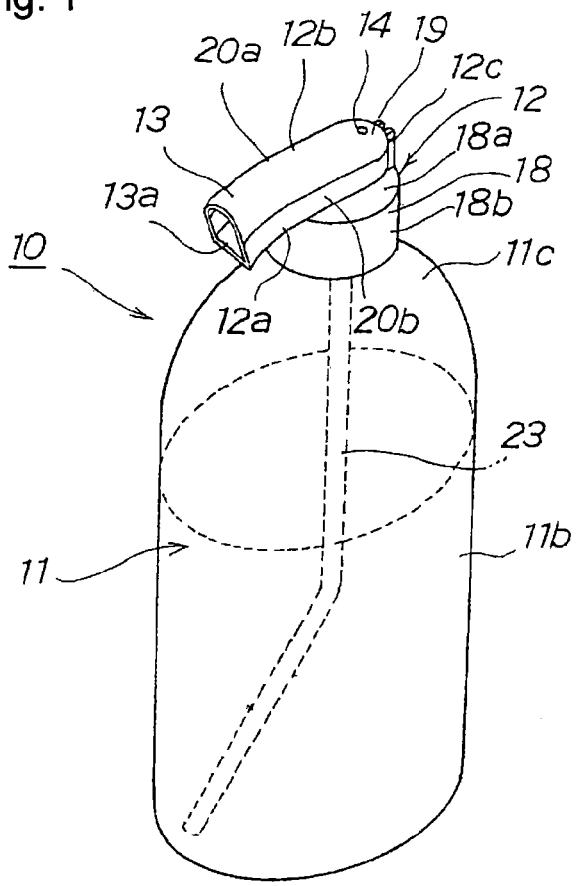
FIG. 1 is a perspective view of a nozzle cap-equipped discharge container according to a preferred embodiment of the invention.

A container in which a valve mechanism for opening and closing an outside air intake port through which the outside air is taken into a container body is provided in the rear of a discharge nozzle portion of a nozzle cap within the range of the height of the discharge nozzle portion to simplify the structure of the nozzle cap and a step of assembling the nozzle cap and to reduce the height of the nozzle cap protruding from a mouth neck section of a container body has been developed (for example, see Patent Literature 3). However, there is a desire for the development of a new nozzle cap-equipped discharge container in which the structure of a nozzle cap and a step of assembling the nozzle cap can be further simplified and the height of the nozzle cap protruding from a mouth neck section of a container body can be reduced.

Further, since the valve mechanism for opening and closing the outside air intake port in the related art uses, for example, a valve member that is separately formed as a separate part made of a material different from a resin material of a main component of the nozzle cap, a structure and an assembling step for providing the valve mechanism in the nozzle cap are complicated.

Meanwhile, for example, a valve mechanism, which is provided with an outside air intake port and a thin plate-like valve portion, is considered as a valve mechanism having a simple structure that opens and closes the outside air intake port. The outside air intake port is formed so as to be opened at an outer peripheral surface of a nozzle cap. The thin plate-like valve portion is rotatably provided, and comes into close contact with an inner surface of an outer peripheral portion of the outside air intake port, which serves as a valve seat portion, so as to cover the formed outside air intake port from the inside of the nozzle cap.

However, in the valve mechanism having the simple structure in which the rotatable thin plate-like valve portion comes into close contact with the inner surface of the outer peripheral portion of the outside air intake port, the valve portion is disposed inside an inner hollow portion of the nozzle cap having a considerable area. Accordingly, since the change of pressure in the container body is not instantly transmitted to the valve portion well, there is a concern that the responsiveness of the valve mechanism may deteriorate. For this reason, it is desired that usability can be improved by allowing the change of pressure in the container body to be instantly transmitted to the valve portion to further improve the responsiveness of the valve mechanism.

Moreover, since the length of the longitudinal discharge flow passage needs to be increased by the length of the gas-liquid mixing chamber when the gas-liquid mixing chamber is provided below a portion of the longitudinal discharge flow passage on which the porous member is mounted, it is difficult to reduce the height of the nozzle cap and to form a compact nozzle cap. For this reason, there is a desire for the development of a new technology that can foam content liquid while mixing the content liquid with air without the deterioration of the quality of foam even when the gas-liquid mixing chamber is not particularly formed or the gas-liquid mixing chamber is formed so as to have a small height.

The invention relates to a nozzle cap-equipped discharge container of which the structure of a nozzle cap and a step of assembling the nozzle cap can be further simplified and which can be formed to be compact through the further reduction of the height of the nozzle cap protruding from a mouth neck section of a container body.

Further, the invention relates to a nozzle cap-equipped discharge container of which a valve mechanism for opening and closing an outside air intake port can be easily formed by a simple structure and a simple assembling step.

Furthermore, the invention relates to a nozzle cap-equipped discharge container in which the change of pressure in a container body is allowed to be instantly transmitted to a valve portion to further improve the responsiveness of the valve mechanism including the valve portion so that usability can be improved.

Moreover, the invention relates to a nozzle cap-equipped discharge container that can foam content liquid while mixing the content liquid with air without the deterioration of the quality of foam even though a gas-liquid mixing chamber is not particularly formed on the longitudinal discharge flow passage or a gas-liquid mixing chamber is formed so as to have a small height.

The invention provides a nozzle cap-equipped discharge container including: a container body that is to contain content liquid; and a nozzle cap that is mounted on a mouth neck section of the container body and includes a discharge section discharging the content liquid fed by the pressurization of the inside of the container body. The nozzle cap includes a longitudinal discharge flow passage that sends upward the content liquid fed from the container body, and a tip-side discharge flow passage that allows the longitudinal discharge flow passage and the discharge section to communicate with each other. The nozzle cap includes a body part and a lid part, and the body part includes the longitudinal discharge flow passage therein. The lid part forms the upper part of a region including a portion directly above the longitudinal discharge flow passage, and the tip-side discharge flow passage includes a flow passage that is formed by the body part and the lid part.

A nozzle cap-equipped discharge container 10 according to a preferred embodiment of the invention illustrated in FIG. 1 is preferably a squeeze foamer container that discharges content liquid from a discharge nozzle portion 13, which is a discharge section, in the form of foam when a user grasps and presses a container body 11 with hands. A nozzle cap 12, which is mounted on a mouth neck section 11*a* (see FIG. 3) of the container body 11, has a function as a squeeze foamer that, with an operation for pressing the container body 11, foams the content liquid while mixing the content liquid with air and discharges the content liquid from the discharge nozzle portion 13 in the form of foam. In the nozzle cap-equipped discharge container 10 of this embodiment, porous members 22, which are to foam the content liquid while mixing the content liquid with air, can be mounted in a longitudinal discharge flow passage 16 from above the discharge nozzle portion 13 that is the discharge section. Accordingly, the structure of the nozzle cap 12 and a step of assembling the nozzle cap 12 are simplified, and the container 10 can be formed to be compact.

Further, the nozzle cap-equipped discharge container 10 of this embodiment is adapted so that an outside air intake port 14 through which the outside air is taken into the container body 11 when the pressing of the container body 11 is released can be opened and closed by an intake valve mechanism 15 having a simple structure and easily assembled.

Furthermore, in the nozzle cap-equipped discharge container 10 of this embodiment, the intake valve mechanism 15 (see FIG. 3), which opens and closes the outside air intake port 14 through which the outside air is taken into the container body due to negative pressure generated in the container body 11 when the pressing of the container body 11 is released, has a simple structure including a cylindrical valve seat portion 15*a* and a valve portion 15*b*, and the change of pressure in the container body 11 is instantly transmitted to the valve portion 15*b*. Accordingly, the responsiveness of the intake valve mechanism 15 is improved.

Moreover, in the nozzle cap-equipped discharge container 10 of this embodiment, a gas-liquid mixing chamber does not need to be provided on the longitudinal discharge flow passage 16 (see FIG. 3) of the nozzle cap 12. Accordingly, the nozzle cap 12 can be formed to be compact and is adapted to be capable of mixing the content liquid with air and foaming the content liquid without the deterioration of the quality of foam.

Figure 2:
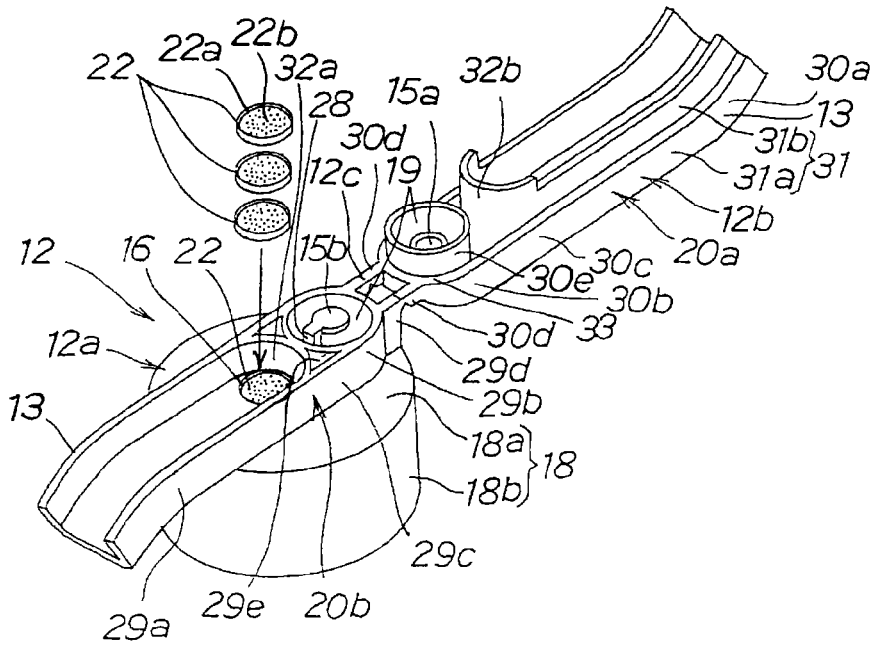
FIG. 2 is a perspective view of a nozzle cap, illustrating a state that a lid part and a body part are opened.
Figure 3:
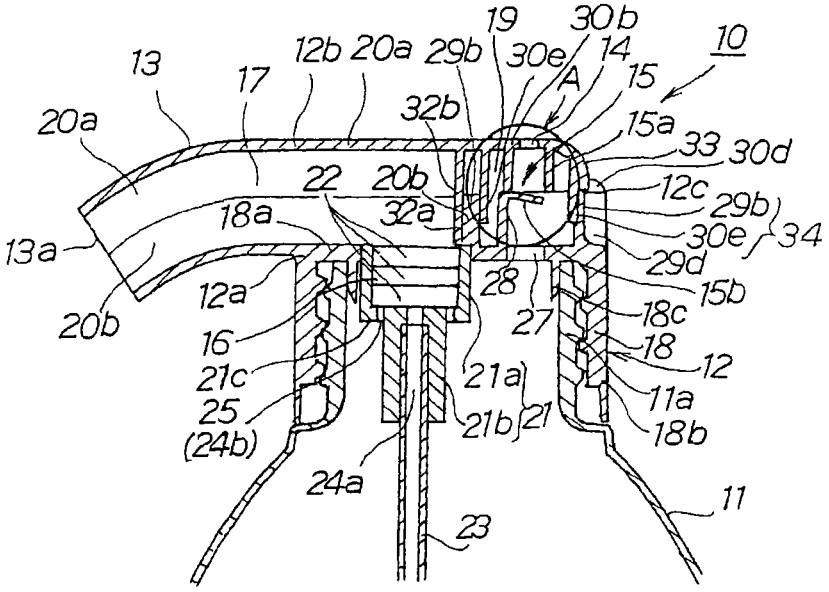
FIG. 3 is a cross-sectional view of main parts of the nozzle cap-equipped discharge container according to the preferred embodiment of the invention.

Further, the nozzle cap-equipped discharge container 10 of this embodiment is a squeeze foamer container 10 including: a container body 11 that is to contain content liquid; and a nozzle cap 12 that is mounted on the mouth neck section 11*a* of the container body 11 and includes a discharge nozzle portion 13 discharging the content liquid fed by the pressurization of the inside of the container body 11. As illustrated in FIGS. 2 and 3, the nozzle cap 12 includes a longitudinal discharge flow passage 16 that sends upward the content liquid fed from the container body 11, and a tip-side discharge flow passage 17 that includes a tip discharge port 13*a* that allows the longitudinal discharge flow passage 16 and the discharge nozzle portion 13 to communicate with each other. The nozzle cap 12 includes a body part 12*a* and a lid part 12*b*, and the body part 12*a* includes the longitudinal discharge flow passage 16 therein. The lid part 12*b* forms an upper part 20*a* of a region including a portion directly above the longitudinal discharge flow passage 16, and the tip-side discharge flow passage 17 includes a flow passage that is formed by the body part 12*a* and the lid part 12*b*.

In this embodiment, the discharge nozzle portion 13 is formed of a discharge nozzle portion that includes a lateral discharge flow passage as the tip-side discharge flow passage 17 and extends in a lateral direction.

In the nozzle cap-equipped discharge container (squeeze foamer container) 10 of this embodiment, the lid part 12*b* forms the upper part 20*a* of a portion including a whole of the discharge nozzle portion 13 that is the discharge section.

In the nozzle cap-equipped discharge container (squeeze foamer container) 10 of this embodiment, the lid part 12*b* is connected to the body part 12*a* by a hinge joint 12*c*. After the lid part 12*b* is molded integrally with the body part 12*a* while being opened (see FIG. 2), the lid part 12*b* is rotated about the hinge joint 12*c*. As a result, the lid part 12*b* is integrally joined to the body part 12*a* (see FIG. 1) in such a manner that the lid part closes an upper portion of a portion including a whole of the discharge nozzle portion 13.

Meanwhile, in this specification, the integral joining is not specified in terms of a joining method and also includes, for example, integration using fitting between the body part and the lid part in addition to various joining methods such as heat sealing. Further, the integral joining also includes integration in which the body part and the lid part integrated with each other can be separated from each other again.

In the nozzle cap-equipped discharge container (squeeze foamer container) 10 of this embodiment, the porous members 22, which are to foam the content liquid, are mounted inside the longitudinal discharge flow passage 16, and the porous members 22 are mounted from above the longitudinal discharge flow passage 16 in a state that the lid part 12*b* and the body part 12*a* are not integrally joined to each other and the lid part 12*b* is opened (see FIG. 2).

In the nozzle cap-equipped discharge container (squeeze foamer container) 10 of this embodiment, an upper end portion of the longitudinal discharge flow passage 16 is formed flush with a top surface plate 18*a* of a cap body portion 18 formed by the body part 12*a*.

In the nozzle cap-equipped discharge container (squeeze foamer container) 10 of this embodiment, the lid part 12*b* is integrally provided with a pressing wall 32*b* that is disposed in an upper end opening of the longitudinal discharge flow passage 16 of the body part 12*a* and that is positioned directly above the outer peripheral edge portion of the porous member 22 mounted inside the longitudinal discharge flow passage 16. In this embodiment, the pressing wall 32*b* serves as a butting wall (upper butting wall) 32*b* to be described below.

In the nozzle cap-equipped discharge container (squeeze foamer container) 10 of this embodiment, the discharge nozzle portion 13 is formed of a discharge nozzle portion that includes a lateral discharge flow passage as the tip-side discharge flow passage 17 as described above and the lid part 12*b* is integrally provided with a butting wall 32*b*, which is disposed at an end portion located opposite to the tip discharge port 13*a* of the lateral discharge flow passage 17, as an upper butting wall at a corner where the lateral discharge flow passage 17 and the longitudinal discharge flow passage 16 communicate with each other. In this embodiment, the butting wall 32*b* serves as the pressing wall 32*b* as described above.

In the nozzle cap-equipped discharge container 10 of this embodiment, the lower surface of the porous member 22 is disposed adjacent to a tip supply port 26*a* of a liquid flow passage 24*a* and tip supply ports 26*b* of air flow passages 24*b*.

In the nozzle cap-equipped discharge container 10 of this embodiment, the plurality of porous members 22 are stacked and mounted inside the longitudinal discharge flow passage 16, and, when seen in the lateral direction, a tip portion of the liquid flow passage 24*a* and a tip portion of the air flow passages 24*b* are formed so as to have a positional relationship where an extension line X from the tip supply port 26*a* in a content liquid supply direction and extension lines Y from the tip supply ports 26*b* in an air supply direction reach the lower surface of the lowermost porous member 22 before crossing each other.

Further, in this specification, a longitudinal direction means an up-and-down direction (corresponding to an up-and-down direction in FIG. 1) when the nozzle cap-equipped discharge container 10 is erected as illustrated in FIG. 1. Furthermore, in this specification, an upper side means a side or a position that is higher than a reference position in the longitudinal direction.

Figure 5:
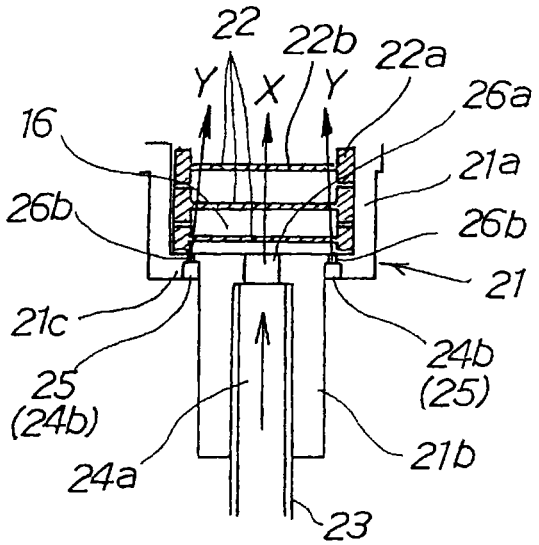
FIG. 5 is an enlarged cross-sectional view illustrating a situation in which content liquid is foamed while being mixed with air by porous members mounted in a longitudinal discharge flow passage.

Moreover, in this specification, the lateral direction, in which a positional relationship between the extension line X from the tip supply port 26*a* in the content liquid supply direction and the extension lines Y from the tip supply ports 26*b* in the air supply direction is seen, is a direction where a portion of the longitudinal discharge flow passage 16 in which the porous members 22 are mounted is seen perpendicular to the direction of the central axis of the longitudinal discharge flow passage 16 as illustrated in FIG. 5.

Further, the nozzle cap-equipped discharge container 10 of this embodiment is adapted so that the outside air intake port 14 can be opened and closed by the intake valve mechanism 15. As illustrated in FIGS. 2 and 3, the outside air intake port 14 is opened at an outer peripheral surface of an outer region of the nozzle cap 12 around the longitudinal discharge flow passage 16 and the outside air is taken into the container body 11 through the outside air intake port 14 when negative pressure is generated in the container body 11. The lid part 12*b* forms the upper part 20*a* of a portion including the region at which the outside air intake port 14 is opened. The intake valve mechanism 15 includes the cylindrical valve seat portion 15*a* that protrudes from an inner surface of the lid part 12*b* so as to surround the outside air intake port 14, and the valve portion 15*b* that is preferably connected to the body part 12*a* in the form of a cantilever so as to be rotatable at a position corresponding to the cylindrical valve seat portion 15*a* and can come into close contact with the lower end face of the cylindrical valve seat portion 15*a*.

In the nozzle cap-equipped discharge container (squeeze foamer container) 10 of this embodiment, the lid part 12*b* forms the upper part 20*a* of a portion that includes the discharge nozzle portion 13 and a region at which the outside air intake port 14 is opened.

In the nozzle cap-equipped discharge container (squeeze foamer container) 10 of this embodiment, the lid part 12*b* is connected to the body part 12*a* by the hinge joint 12*c*. After the lid part 12*b* is molded integrally with the body part 12*a* while being opened (see FIG. 2), the lid part 12*b* is rotated about the hinge joint 12*c*. As a result, the lid part 12*b* is integrally joined to the body part 12*a* (see FIG. 1) in such a manner that the lid part closes an upper portion of a portion including the discharge nozzle portion 13 and the region at which the outside air intake port 14 is opened.

In addition, in the nozzle cap-equipped discharge container 10 of this embodiment, as illustrated in FIGS. 2 and 3, an outside air intake chamber 19 is disposed above the top surface plate 18*a* of the cap body portion 18 of the nozzle cap 12, and the outside air intake port 14, which is opened at an upper surface portion of the outside air intake chamber 19 and through which the outside air is taken into the container body 11 when negative pressure is generated in the container body 11, is provided so as to openable by the intake valve mechanism 15 provided inside the outside air intake chamber 19. The intake valve mechanism 15 includes the valve seat portion (cylindrical valve seat portion) 15*a* that is provided on the inner surface of the outside air intake chamber 19 so as to surround the outside air intake port 14, and the valve portion 15*b* that is preferably supported by a valve support portion (valve support piece) 28 so as to be rotatably provided at a position corresponding to the valve seat portion 15*a* and can come into close contact with the valve seat portion 15*a*. The outside air intake chamber 19 includes an annular partition 34 that partitions a periphery of the intake valve mechanism 15. An upper end portion of the annular partition 34 is joined to the upper surface portion of the outside air intake chamber 19 and a lower end portion of the annular partition 34 is joined to the top surface plate 18*a* of the cap body portion 18. Accordingly, the annular partition 34 is provided so as to airtightly partition an outside air-intake flow passage which extends from the outside air intake port 14 to a top plate-outside air intake port 27, which is opened at the top surface plate 18*a*.

In this embodiment, the nozzle cap 12 has a two-part structure that includes the body part 12*a* and the lid part 12*b*. The lid part 12*b* forms the upper part 20*a* of a portion that includes the outside air intake chamber 19. The annular partition 34 includes a lid-side annular partition (a cylindrical wall portion of an upper intake chamber part) 30*e* that protrudes from an inner surface of the lid part 12*b* so as to surround the valve seat portion (cylindrical valve seat portion) 15*a*, and a body-side annular partition (lower intake chamber part) 29*b* that is formed on the body part 12*a* so as to surround the top plate-outside air intake port 27 and be erected from the top surface plate 18*a*. When the body part 12*a* and the lid part 12*b* are integrally joined to each other, the lower end portion of the lid-side annular partition (the cylindrical wall portion of the upper intake chamber part) 30*e* and the upper end portion of the body-side annular partition (lower intake chamber part) 29*b* come into close contact with each other. Accordingly, the annular partition 34 is provided so as to airtightly partition the outside air-intake flow passage.

In this embodiment, the lid part 12*b* forms the upper part 20*a* of a portion that includes the discharge nozzle portion 13 and the outside air intake chamber 19. The lid part 12*b* is connected to the body part 12*a* by the hinge joint 12*c*. After the lid part 12*b* is molded integrally with the body part 12*a* while being opened, the lid part 12 is rotated about the hinge joint 12*c*. As a result, the lid part 12*b* is integrally joined to the body part 12*a* in such a manner that the lid part closes an upper portion of a portion including the discharge nozzle portion 13 and the outside air intake chamber 19. Accordingly, the lateral discharge flow passage 17, which is the tip-side discharge flow passage, is formed so as to communicate with the longitudinal discharge flow passage 16 through the lid part 12*b*.

In this embodiment, the valve seat portion 15*a* of the intake valve mechanism 15 is formed of the cylindrical valve seat portion 15*a* that protrudes from the inner surface of the lid part 12*b* so as to surround the outside air intake port 14. The valve portion 15*b* of the intake valve mechanism 15 is connected to the valve support portion (valve support piece) 28, which is erected from the top surface plate 18*a* of the cap body portion 18, in the form of a cantilever so as to be rotatable at a position corresponding to the valve seat portion (cylindrical valve seat portion) 15*a*.

Moreover, in the nozzle cap-equipped discharge container 10 of this embodiment, as illustrated in FIGS. 2 and 3, the porous members 22, which are to foam content liquid, are mounted inside the longitudinal discharge flow passage 16 that is provided in the nozzle cap 12 and sends the content liquid mixed with air to the discharge nozzle portion 13. As also illustrated in FIG. 5, the tip supply port 26*a* of the liquid flow passage 24*a* to which the content liquid is pumped and supplied from the container body 11 and the tip supply ports 26*b* of the air flow passages 24*b* to which air is pumped and supplied from the container body 11 are opened at the inner surface of a portion of the longitudinal discharge flow passage 16 that is positioned below the porous members 22. When seen in the lateral direction (a direction in which the porous members are seen laterally), the tip portion of the liquid flow passage 24*a* and the tip portion of the air flow passages 24*b* are formed so as to have a positional relationship where the extension line X from the tip supply port 26*a* of the liquid flow passage 24*a* in the content liquid supply direction and the extension lines Y from the tip supply ports 26*b* of the air flow passages 24*b* in the air supply direction do not extend parallel to each other and reach the lower surface of the porous member 22 before crossing each other.

In the nozzle cap-equipped discharge container 10 of this embodiment, the lower surface of the porous member 22 is disposed adjacent to the tip supply port 26*a* of the liquid flow passage 24*a* and the tip supply ports 26*b* of the air flow passages 24*b*.

In the nozzle cap-equipped discharge container 10 of this embodiment, the plurality of porous members 22 are stacked and mounted inside the longitudinal discharge flow passage 16, and, when seen in the lateral direction, the tip portion of the liquid flow passage 24*a* and the tip portion of the air flow passages 24*b* are formed so as to have a positional relationship where the extension line X from the tip supply port 26*a* in the content liquid supply direction and the extension lines Y from the tip supply ports 26*b* in the air supply direction reach the lower surface of the lowermost porous member 22 before crossing each other.

In this embodiment, the container body 11 of the squeeze foamer container 10 is a bottle-shaped blow molding that has flexibility and is made of plastic as illustrated in FIG. 1. The container body 11 includes a bottomed cylindrical body section 11*b* that has, for example, a substantially oval cross-sectional shape, a shoulder section 11*c* that is formed in the shape of a curved surface so that the diameter of the shoulder section 11*c* is reduced toward the upper side from an upper end portion of the body section 11*b*, and the mouth neck section 11*a* (see FIG. 3) that is formed in a cylindrical shape so as to protrude upward from an upper end portion of the shoulder section 11*c*. The body section 11*b* has an outer diameter in the range of, for example, about 40 to 80 mm as an outer diameter to be easy to grasp with hands. The mouth neck section 11*a* has an outer diameter in the range of, for example, about 25 to 65 mm which is smaller than the outer diameter of the body section 11*b*. Male threads with which the nozzle cap 12 is to be threadedly engaged are formed on the outer peripheral surface of the mouth neck section 11*a*. For example, one of polyolefin-based resins, such as polypropylene (PP), high-density polyethylene (HDPE), medium-density polyethylene (MDPE), and low-density polyethylene (LDPE), and a polyester-based resin such as polyethylene terephthalate (PET) or a mixture of plural materials appropriately selected from them is used as the plastic material of the container body 11 so that squeeze deformation (press deformation) easily occurs.

In this embodiment, the nozzle cap 12 is an injection molding made of, for example, plastic, and the body part 12*a* and the lid part 12*b* are formed integrally with each other while being opened as illustrated in FIG. 2. For example, polypropylene (PP) can be used as a plastic material that is used to form the nozzle cap 12.

As illustrated in FIGS. 2 and 3, the body part 12*a* of the nozzle cap 12 includes: the cap body portion 18; and a lower part 20*b* of a portion that includes the discharge nozzle portion 13 and the outside air intake chamber 19 and that is formed integrally with the top surface plate 18*a* so as to protrude upward from the top surface plate 18*a* of the cap body portion 18. The outside air intake chamber 19 is formed in a region, which is present on one side of the longitudinal discharge flow passage 16 opposite to the lateral discharge flow passage 17, of the nozzle cap 12 as an outer region that is present around the longitudinal discharge flow passage 16. The outside air intake port 14 is opened at the outer peripheral surface of the upper intake chamber part 30*b* of the upper part 20*a* that forms the upper surface portion of the outside air intake chamber 19. The lower part 20*b* of a portion, which includes the discharge nozzle portion 13 and the outside air intake chamber 19, forms the discharge nozzle portion 13 and the outside air intake chamber 19 by being integrally joined to the upper part 20*a*, which is formed by the lid part 12*b*, of a portion that includes the discharge nozzle portion 13 and the outside air intake chamber 19. Accordingly, the upper part 20*a*, which is formed by the lid part 12*b*, includes a region of the discharge nozzle portion 13 that includes a portion directly above the longitudinal discharge flow passage 16. The discharge nozzle portion 13, which is the discharge section, protrudes upward from the top surface plate 18*a* of the body part 12*a* and is formed integrally with the top surface plate 18*a*.

The cap body portion 18 includes: the disc-shaped top plate portion 18*a*; and a mounting skirt portion 18*b* that extends downward from the peripheral edge portion of the top plate portion 18*a* and that is formed in a cylindrical shape. Female threads, which are to be engaged with the male threads formed on the outer peripheral surface of the mouth neck section 11*a* of the container body 11, are formed on the inner peripheral surface of the mounting skirt portion 18*b*. An inner ring 18*c* is provided inside the mounting skirt portion 18*b* so as to be disposed concentrically with the mounting skirt portion 18*b* with an interval therebetween and protrude from the lower surface of the top plate portion 18*a* in an annular shape (see FIG. 3). When the nozzle cap 12 is mounted on the mouth neck section 11*a* of the container body 11, the inner ring 18*c* is disposed so as to come into close contact with the inner peripheral surface of a tip opening of the mouth neck section 11*a*. Accordingly, the inner ring 18*c* improves sealing performance at the rim of the tip opening.

In this embodiment, an upper end opening surface is formed at the top plate portion 18*a* of the cap body portion 18 so that a two-stage cylindrical portion 21 is formed integrally with the top plate portion 18*a* at an eccentric position that is closer to the tip discharge port 13*a* of the discharge nozzle portion 13 than the central portion of the top plate portion 18*a* (see FIG. 3). The two-stage cylindrical portion 21 has a two-stage structure that includes a large-diameter cylinder section 21*a* located on an upper side and a small-diameter cylinder section 21*b* located on a lower side. The large-diameter cylinder section 21*a* located on an upper side forms the longitudinal discharge flow passage 16 for content liquid that sends upward the content liquid fed from the container body 11. That is, in the nozzle cap-equipped discharge container 10 of this embodiment, the upper end portion of the longitudinal discharge flow passage 16 and the top surface plate 18*a* of the cap body portion 18, which is formed by the body part 12*a*, are formed flush with each other and connected to each other. In this embodiment, the plurality of (three in this embodiment) porous members 22 made of, for example, a mesh-like material are stacked and mounted inside the longitudinal discharge flow passage 16 that is formed by the large-diameter cylinder section 21*a*. It is possible to discharge content liquid from the tip discharge port 13*a* of the discharge nozzle portion 13 in the form of foam by making the content liquid pass through the porous members 22 while mixing the content liquid with air. Further, since the upper end portion of the longitudinal discharge flow passage 16 and the top surface plate 18*a* of the cap body portion 18 are connected to each other and are flush with each other, the height of the container can be reduced. Accordingly, the container can be formed to be compact. Furthermore, since the porous members 22 can be inserted into the large-diameter cylinder section 21*a* of the two-stage cylindrical portion 21 so as to be along with the top surface plate 18*a*, workability during assembly can be improved.

An upper end portion of a dip tube 23, which extends to the bottom part of the container body 11, is mounted on the small-diameter cylinder section 21*b* located on a lower side of the two-stage cylindrical portion 21. Accordingly, the small-diameter cylinder section 21*b* forms the liquid flow passage 24*a* together with the upper end portion of the dip tube 23. The liquid flow passage 24*a* feeds content liquid to the longitudinal discharge flow passage 16, which is formed by the large-diameter cylinder section 21*a*, by an operation for pressing the container body 11.

Further, in this embodiment, an annular flange 21*c* is formed at a stepped portion between the large-diameter cylinder section 21*a* and the small-diameter cylinder section 21*b*, and a plurality of air holes 25 are formed in the annular flange 21*c* at intervals in a circumferential direction so as to pass through the annular flange 21*c* in the longitudinal direction. The air holes 25 form the air flow passages 24*b*. By an operation for pressing the container body 11, the air flow passages 24*b* feed air, which is present in the container body 11, to the longitudinal discharge flow passage 16, at the same time of feeding content liquid to the longitudinal discharge flow passage 16 through the liquid flow passage 24*a*, which is formed by the dip tube 23 and the small-diameter cylinder section 21*b*.

The content liquid and air fed to the longitudinal discharge flow passage 16, which is formed by the large-diameter cylinder section 21*a*, through the liquid flow passage 24*a* and the air flow passages 24*b* by an operation for pressing the container body 11 pass through the porous members 22 mounted in the longitudinal discharge flow passage 16 while being mixed with each other in the longitudinal discharge flow passage 16, and, the content liquid is easily foamed and becomes fine. The content liquid, which becomes fine foam by being foamed, is sent to the lateral discharge flow passage 17 formed by the discharge nozzle portion 13, and is discharged from the tip discharge port 13*a* in the form of foam.

Here, in this embodiment, as illustrated in FIG. 5, the lower surface of the porous member 22 is disposed adjacent to the tip supply port 26*a* of the liquid flow passage 24*a*, which is formed by the dip tube 23 and the small-diameter cylinder section 21*b*, and the tip supply ports 26*b* of the air flow passages 24*b* that are formed by the air holes 25. Further, when seen in the lateral direction, the tip portion of the liquid flow passage 24*a* and the tip portion of the air flow passages 24*b* are formed so as to have a positional relationship where the extension line X from the tip supply port 26*a* of the liquid flow passage 24*a* in the content liquid supply direction and the extension lines Y from the tip supply ports 26*b* of the air flow passages 24*b* in the air supply direction reach the lower surface of the porous member 22 before crossing each other.

Accordingly, when air passes through each porous member 22, turbulence such as eddies is generated due to the collision between the air and each porous member 22 and the air and content liquid are mixed with each other while causing turbulence. Accordingly, high-quality foam can be generated.

Further, in this embodiment, the porous members 22 mounted in the longitudinal discharge flow passage 16, which is formed by the large-diameter cylinder section 21*a*, are porous members 22 made of, for example, a mesh-like material. Preferably, a molded mesh can be used as the porous member. Since it is possible to manufacture the molded mesh by using a molding machine in such a manner that an outer peripheral frame portion 22*a* and a mesh plate portion 22*b* to be described below are integrated, the molded mesh is inexpensive and a plurality of porous members 22 can be easily stacked and mounted inside the longitudinal discharge flow passage 16. Furthermore, it is preferable that the plurality of molded meshes 22 are stacked and mounted inside the longitudinal discharge flow passage 16, and it is preferable that the plurality of molded meshes 22 are stacked, disposed, and mounted in such a manner that the positions of mesh holes deviate from one another when seen from above. It is possible to form foam, which is finer and has higher quality, by these porous members. Meanwhile, a method of mounting the molded meshes 22 in such a manner that the molded meshes 22 adjacent to each other in the longitudinal direction are rotated relative to each other in the circumferential direction by a predetermined rotation angle, a method of changing the positions or the number of the mesh holes of the molded mesh 22 adjacent to each other in the longitudinal direction, or the like can be employed as a method of stacking and disposing the molded meshes 22 in such a manner that the positions of mesh holes deviate from one another.

As illustrated in FIGS. 2 and 5, the molded mesh 22 has a two-stage structure that includes the thick annular outer peripheral frame portion 22*a* and the mesh plate portion 22*b*. The outer peripheral edge portion of the mesh plate portion 22*b* is joined to the outer peripheral frame portion 22*a*, so that the mesh plate portion 22*b* covers the inner opening of the outer peripheral frame portion 22*a* and is provided in the form of a membranella at the middle portion of the outer peripheral frame portion 22*a* in a thickness direction. The mesh plate portion 22*b* is provided in the form of a membranella at the middle portion of the outer peripheral frame portion 22*a* in a thickness direction, and is provided with a plurality of mesh holes. Accordingly, since the plurality of molded meshes 22, which are mounted in the longitudinal discharge flow passage 16, are stacked in such a manner that the outer peripheral frame portions 22*a* come into contact with each other as support legs, a space can be ensured between the mesh plate portions 22*b* of the molded meshes 22 adjacent to each other in the longitudinal direction. Further, content liquid and air, which are pumped from the tip supply port 26*a* of the liquid flow passage 24*a* and the tip supply ports 26*b* of the air flow passages 24*b* and pass through the mesh plate portion 22*b* through the plurality of mesh holes and infiltrate into the back side of the mesh plate portion 22*b* after reaching the mesh plate portion 22*b* forming the lower surface of the lowermost molded mesh 22 before being mixed with each other as described below, pass through the upper mesh plate portion 22*b* while being effectively mixed with each other in the space, which is ensured between the mesh plate portions 22*b* adjacent to each other in the longitudinal direction, as a mixing space. Therefore, it is possible to form foam, which is finer and has higher quality, by these porous members. It is also possible to form foam, which is finer and has higher quality, by napping the molded meshes.

Meanwhile, in the invention, well-known various foam fining members, which are formed of sponge, sintered metal, or the like other than a mesh-like material, such as the molded mesh 22, and fine foam formed of a mixture of content liquid and air, can be used as the porous member 22 that is mounted in the longitudinal discharge flow passage 16. Further, the plurality of porous members 22 does not necessarily need to be stacked and mounted inside the longitudinal discharge flow passage 16, and one or a plurality of porous members 22 can be mounted and used in the longitudinal discharge flow passage 16 according to the size, the shape, or the like of the porous member 22.

Furthermore, in this embodiment, as illustrated in FIG. 5, the lower surface of the porous member 22, which is formed by the mesh plate portion 22*b* of the lowermost molded mesh 22, is disposed adjacent to the tip supply port 26*a* of the liquid flow passage 24*a*, which is formed by the dip tube 23 and the small-diameter cylinder section 21*b*, and the tip supply ports 26*b* of the air flow passages 24*b* that are formed by the air holes 25. Moreover, when seen in the lateral direction, the tip portion of the liquid flow passage 24*a* and the tip portion of the air flow passages 24*b* are formed so as to have a positional relationship where the extension line X from the tip supply port 26*a* in the content liquid supply direction and the extension lines Y from the tip supply ports 26*b* in the air supply direction do not extend parallel to each other and reach the lower surface of the lowermost porous member 22 before crossing each other. That is, the respective portions are designed and disposed in such a manner that the extension line X in the content liquid supply direction and the extension lines Y in the air supply direction do not extend parallel to each other, and do not cross each other on at least the lower surface of the lowermost porous member 22 (the lower surface formed by the mesh plate portion 22*b* of the lowermost molded mesh 22). For example, the tip supply ports 26*b* of the air flow passages 24*b* may be disposed not to be perpendicular to the mesh plate portion 22*b* of the molded mesh 22. Meanwhile, in terms of the formation of foam, which is finer and has higher quality, it is preferable that the respective portions are designed and disposed so that the extension line X in the content liquid supply direction and the extension lines Y in the air supply direction do not cross each other even on the lower surface of the uppermost porous member 22 (the lower surface formed by the mesh plate portion 22*b* of the uppermost molded mesh 22).

In addition, in this embodiment, as illustrated in FIG. 3, the top plate portion-outside air intake port 27 is formed in a region, which is present on one side of the longitudinal discharge flow passage 16 opposite to the tip discharge port 13*a* of the discharge nozzle portion 13, of the top plate portion 18*a* of the cap body portion 18 so as to be disposed directly below the outside air intake chamber 19. The top plate portion-outside air intake port 27 allows the outside air intake chamber 19, which is formed so as to be disposed above the top surface plate 18*a*, to communicate with the container body 11. Accordingly, since the pressure of an inner space of the outside air intake chamber 19 in which the intake valve mechanism 15 is provided is the same as the pressure of an inner space of the container body 11, the outside air intake port 14 can be smoothly opened and closed by the intake valve mechanism 15 with an operation for pressing the container body 11 or releasing the pressing of the container body.

Moreover, in this embodiment, the valve support piece 28 is provided as a valve support portion so as to be integrally erected upward from the top surface plate 18*a* at the rim of the opening of the top plate portion-outside air intake port 27. The thin plate-like valve portion 15*b* of the intake valve mechanism 15, which is connected to the tip portion of the valve support piece 28 in the form of a cantilever, is provided so as to be rotated by an elastic force thereof.

Here, a method of connecting the valve portion 15*b* to the tip portion of the valve support piece 28 is not particularly limited. The valve portion 15*b* and the valve support piece 28 may be integrally molded so as to be connected to each other, or a valve portion 15*b* and a valve support piece 28, which are manufactured as separate parts, may be connected to each other by heat sealing or the like.

As illustrated in FIG. 2, the lower part 20*b*, which forms the body part 12*a* of the nozzle cap 12 together with the cap body portion 18, is a substantially lower half part of a portion including the discharge nozzle portion 13 and the outside air intake chamber 19, and includes a lower nozzle part 29*a*, a lower intake chamber part (body-side annular partition) 29*b*, lower connecting parts 29*c*, and lower hinge parts 29*d* in this embodiment.

Preferably, the lower nozzle part 29*a* is formed in a shape including the top plate portion 18*a* of the cap body portion 18 as a bottom surface and includes side walls erected from the top plate portion 18*a*, and has a substantially U shaped cross-sectional shape in which an open side is disposed at an upper portion (a cross-sectional shape having three sides in which one side of a tetragon is removed to form an open side, or the shape of a rain gutter or a channel steel of which the upper side is opened). The lower nozzle part 29*a* is formed so as to extend in the lateral direction along the top plate portion 18*a* from a portion of the top plate portion 18*a* of the cap body portion 18 where the longitudinal discharge flow passage 16 is opened. A base end portion, which is located closer to the longitudinal discharge flow passage 16, of the lower nozzle part 29*a* is closed by a lower butting wall 32*a* that is curved in a substantially semicircular shape. A tip portion of the lower nozzle part 29*a* present on one side of a portion, at which the longitudinal discharge flow passage 16 is opened, opposite to the lower butting wall 32*a* protrudes outward from the peripheral edge portion of the top plate portion 18*a*, and extends so as to be slightly bent downward.

The lower intake chamber part 29*b* is a portion that forms the body-side annular partition, and is a cylindrical portion that is disposed on one side of the substantially semicircular lower butting wall 32*a* of the lower nozzle part 29*a* opposite to the longitudinal discharge flow passage 16 and that is erected from the top surface plate 18*a* of the cap body portion 18. The lower intake chamber part 29*b* protrudes upward from the top surface plate 18*a* so as to have a height equal to the height of the lower nozzle part 29*a*, and is formed so as to have an outer diameter equal to the outer width of the lower nozzle part 29*a*. The valve portion 15*b* is provided inside the lower intake chamber part 29*b* so as to be rotatably supported by the valve support piece 28 erected from the top surface plate 18*a* as described above.

The lower connecting parts 29*c* are portions that smoothly connect the outer peripheral surface of the lower nozzle part 29*a* to the outer peripheral surface of the lower intake chamber part 29*b*. A pair of lower connecting parts 29*c* is disposed so as to have an outer width equal to the outer width of the lower nozzle part 29*a*. The lower connecting parts 29*c* are provided at both side portions of the lower part 20*b* so as to partition a portion between the lower nozzle part 29*a* and the lower intake chamber part 29*b*. Compartments 29*e*, which are surrounded by the lower nozzle part 29*a*, the lower intake chamber part 29*b*, and the lower connecting parts 29*c* and have a substantially triangular hollow cross-sectional shape, are formed inside the lower connecting parts 29*c*.

The lower hinge parts 29*d* are a pair of longitudinal rib-shaped portions protruding outward from the outer peripheral surface of the lower intake chamber part 29*b* that is present on one side of the lower connecting parts 29*c* opposite to the lower nozzle part 29*a*. Tip edge portions of upper end faces of the lower hinge parts 29*d* are joined to tip edge portions of lower end faces of upper hinge parts 30*d* so as to be bendable relative to the tip edge portions of the lower end faces of the upper hinge parts 30*d*, and form the hinge joint 12*c*.

The upper part 20*a*, which forms the lid part 12*b*, is a substantially upper half part of the portion including the discharge nozzle portion 13 and the outside air intake chamber 19, and includes an upper nozzle part 30*a*, an upper intake chamber part 30*b*, upper connecting parts 30*c*, and upper hinge parts 30*d* in this embodiment.

Since the upper nozzle part 30*a* is formed so as to includes a region directly above the longitudinal discharge flow passage 16, and has a substantially U shaped cross-sectional shape in which an open side is disposed at a lower portion (a cross-sectional shape having three sides in which one side of a tetragon is removed to form an open side, or the shape of a rain gutter or a channel steel of which the lower side is opened). The upper nozzle part 30*a* has a two-stage structure in which each of both side wall portions 31 of the upper nozzle part 30*a* includes an outer side wall portion 31*a* and an inner side wall portion 31*b*. The outer side wall portions 31*a* are formed so as to have an outer width equal to the outer width of the lower nozzle part 29*a*, and are formed so as to have a height and a length equal to the height and the length of the lower nozzle part 29*a*. When the lid part 12*b* is closed, the lower end faces of the outer side wall portions 31*a* come into close contact with upper end faces of both side wall portions of the lower nozzle part 29*a*, respectively.

The inner side wall portions 31*b* are formed so as to have an outer width equal to the inner width of the lower nozzle part 29*a*, and are formed so as to be higher than the outer side wall portions 31*a* over the entire length of the outer side wall portions 31*a*. End portions, which are located close to the upper intake chamber part 30*b*, of both the inner side wall portions 31*b* are connected to each other by an upper butting wall 32*b* that is formed so as to be higher than the inner side wall portion 31*b* and is curved in a substantially semicircular shape. Accordingly, a base end portion, which is located close to the upper intake chamber part 30*b*, of the upper nozzle part 30*a* is closed by the substantially semicircular upper butting wall 32*b*. The radius of curvature of the outer peripheral surface of the substantially semicircular upper butting wall 32*b* is substantially equal to the radius of curvature of the inner peripheral surface of the substantially semicircular lower butting wall 32*a*.

When the lid part 12*b* is closed, the lower end faces of the outer side wall portions 31*a* come into close contact with the upper end faces of both the side wall portions of the lower nozzle part 29*a*, and the inner side wall portions 31*b* are mounted so as to be fitted into the inside of the side wall portions of the lower nozzle part 29*a* in a state that the outer surface of the inner side wall portions 31*b* come into close contact with the inner surfaces of both the side wall portions of the lower nozzle part 29*a*. Further, when the lid part 12*b* is closed, the upper butting wall 32*b* is mounted so as to be fitted into the inside of the lower butting wall 32*a* in a state that the outer peripheral surface of the upper butting wall 32*b* comes into close contact with the inner peripheral surface of the lower butting wall 32*a* of the lower nozzle part 29*a*, so that the discharge nozzle portion 13 in which the lower nozzle part 29*a* and the upper nozzle part 30*a* are integrated with each other is formed by these walls and portions.

Furthermore, in this embodiment, when the lid part 12*b* is closed, the tip of the upper butting wall 32*b* is disposed inside the upper end opening of the longitudinal discharge flow passage 16 formed by the large-diameter cylinder section 21*a* of the two-stage cylindrical portion 21 and is positioned directly above the outer peripheral frame portion 22*a* forming the outer peripheral edge portion of the porous member 22. Accordingly, the upper butting wall 32*b* functions as a pressing wall and can stably fix the porous members 22 that are mounted in the large-diameter cylinder section 21*a*.

In addition, the upper butting wall 32*b* is disposed at the end portion located opposite to the tip discharge port 13*a* of the lateral discharge flow passage 17, at the corner where the lateral discharge flow passage 17 and the longitudinal discharge flow passage 16 communicate with each other, and functions as the butting wall that closes the end portion located opposite to the tip discharge port 13*a* of the lateral discharge flow passage. In this embodiment, the inner surface of the butting wall formed of the upper butting wall 32*b* has a curved shape, and preferably has a substantially semicircular cross-sectional shape that is curved in an arc shape. The butting wall is not limited to a wall having this shape, and may be a wall having, for example, a U shaped cross-sectional shape in which an open side is disposed to face the tip discharge port 13*a* (a cross-sectional shape having three sides in which one side of a tetragon is removed to form an open side) or a C-shaped cross-sectional shape in which an open side is disposed to face the tip discharge port 13*a*. Further, the butting wall formed of the upper butting wall 32*b* may have a shape in which a notch or a slit is formed at a part (a portion close to the tip discharge port 13*a*) of a side surface of a pipe (of which the cross-sectional shape may be a circular shape, a quadrangular shape, or other shapes).

When the upper butting wall 32*b* is formed in the above-mentioned shape, the discharge direction of the content liquid, which is contained in the container body 11, can be easily changed to the side of the tip discharge port 13*a* of the lateral discharge flow passage 17 while the porous members 22 can be stably fixed. Accordingly, the discharge container 10 can be formed to be compact.

The upper intake chamber part 30*b* is a portion that is disposed on one side of the substantially semicircular upper butting wall 32*b* of the upper nozzle part 30*a* opposite to the upper nozzle part 30*a*. The upper intake chamber part 30*b* includes a top surface portion of the lid part 12*b* as an upper surface portion of the outside air intake chamber 19, and includes a cylindrical wall portion 30*e* that protrudes downward from the inner surface of the top surface portion of the lid part 12*b* in a cylindrical shape. The cylindrical wall portion 30*e* is a portion of a lid-side annular partition that forms the annular partition 34 together with the lower intake chamber part 29*b*. The cylindrical wall portion (lid-side annular partition) 30*e* of the upper intake chamber part 30*b* protrudes so as to have a height higher than the height of the outer side wall portion 31*a* of the upper nozzle part 30*a*, and has an outer diameter equal to the inner diameter of the lower intake chamber part 29*b* of the lower part 20*b*. The cylindrical valve seat portion 15*a*, which is disposed concentrically with the cylindrical wall portion 30*e* and protrudes from the inner surface of the lid part 12*b* in a cylindrical shape so as to surround the outside air intake port 14 formed at the upper surface portion of the outside air intake chamber 19, is provided inside the cylindrical wall portion 30*e*. The cylindrical valve seat portion 15*a* is formed so as to have a height equal to the height of the outer side wall portion 31*a* of the upper nozzle part 30*a*. Further, an outer peripheral contact wall 33 is formed outside a region of a substantially semicircular portion, which is located closer to the hinge joint 12*c*, of the cylindrical wall portion

30*e* of the upper intake chamber part 30*b*. The outer peripheral contact wall 33 is continued to both the outer side wall portions 31*a* of the upper nozzle part 30*a* through both the upper connecting parts 30*c* so as to have a height equal to the height of the outer side wall portion 31*a*, and is integrally formed along the outer peripheral surface of the cylindrical wall portion 30*e*.

Figure 4:
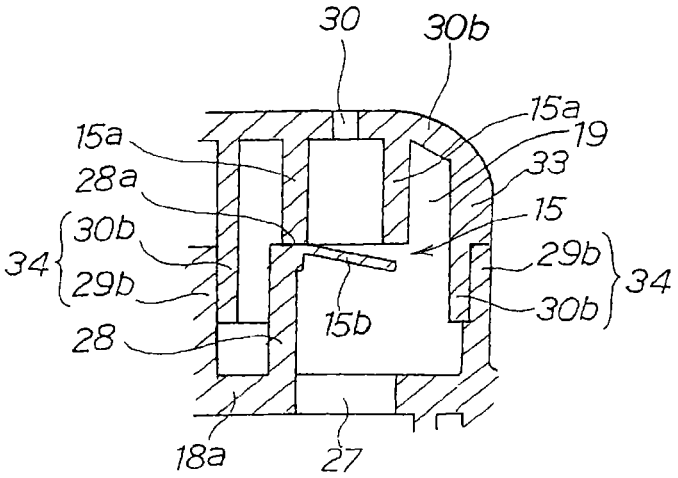
FIG. 4 is an enlarged cross-sectional view of a portion A of FIG. 3, illustrating the structure of an intake valve mechanism.

When the lid part 12*b* is closed, the lower end face of the outer peripheral contact wall 33 formed outside the cylindrical wall portion 30*e* comes into contact with the upper end face of a region of the substantially semicircular portion, which is located closer to the hinge joint 12*c*, of the lower intake chamber part 29*b* as illustrated in FIGS. 3 and 4. Furthermore, the lower end portion, which protrudes downward from the outer peripheral contact wall 33, of the cylindrical wall portion 30*e* of the upper intake chamber part 30*b* is mounted so as to be fitted into the inside of the lower intake chamber part 29*b* in a state that the outer peripheral surface of the lower end portion, which protrudes downward from the outer peripheral contact wall 33, of the cylindrical wall portion 30*e* of the upper intake chamber part 30*b* comes into close contact with the inner surface of the upper end portion of the lower intake chamber part 29*b*. Accordingly, the lower end portion of the lid-side annular partition, which is formed of the cylindrical wall portion 30*e*, and the upper end portion of the body-side annular partition 29*b* come into close contact with each other and are firmly joined to each other, so that the annular partition 34 in which the cylindrical wall portion 30*e* and the body-side annular partition 29*b* are integrated with each other is formed. The annular partition 34 is provided so as to airtightly partition the outside air-intake flow passage, which extends from the outside air intake port 14 to the top plate portion-outside air intake port 27, together with the upper surface portion of the outside air intake chamber 19 and the top plate portion 18*a* of the cap body portion 18. Accordingly, the outside air intake chamber 19, which is disposed above the top surface plate 18*a* of the cap body portion 18 of the nozzle cap 12 and includes the annular partition 34 partitioning a periphery of the intake valve mechanism 15, is formed.

Further, since the tip portion of the cylindrical wall portion 30*e* of the upper intake chamber part 30*b* is mounted so as to be fitted into the inside of the lower intake chamber part 29*b* in a state that the outer peripheral surface of the tip portion of the cylindrical wall portion 30*e* comes into close contact with the inner surface of the lower intake chamber part 29*b*, the annular partition 34 is formed outside the intake valve mechanism 15. The annular partition 34 includes the cylindrical wall portion 30*e* of the upper intake chamber part 30*b* and the lower intake chamber part 29*b* that partition a periphery of the intake valve mechanism 15. The upper end portion of the annular partition 34 is joined to the inner surface of the outside air intake chamber 19 so as to surround the outside air intake port 14, and the lower end portion of the annular partition 34 is joined to the top plate portion 18*a* of the cap body portion 18 so as to surround the top plate portion-outside air intake port 27. Accordingly, the annular partition 34 is provided so as to airtightly partition the outside air-intake flow passage which extends from the outside air intake port 14 to the top plate portion-outside air intake port 27.

Since the annular partition 34, which includes the cylindrical wall portion 30*e* of the upper intake chamber part 30*b* and the lower intake chamber part 29*b*, is provided so as to airtightly partition the outside air-intake flow passage which extends from the outside air intake port 14 to the top plate portion-outside air intake port 27, it is possible to avoid the leakage of air, which passes through the outside air-intake flow passage (which extends from the outside air intake port 14 to the top plate portion-outside air intake port 27 and in which the intake valve mechanism 15 is disposed), to the outside of the annular partition 34 which is caused by an operation for grasping and pressing the container body 11 with hands or releasing the pressing of the container body. Accordingly, it is possible to improve the responsiveness of the intake valve mechanism 15 and to improve the ease of use of the nozzle cap-equipped discharge container 10.

Further, in this embodiment, when the lid part 12*b* is closed, the lower end face of the cylindrical valve seat portion 15*a*, which protrudes downward from the inner surface of the lid part 12*b* so as to surround the outside air intake port 14, comes into close contact with the upper end face 28*a*, to which the valve portion 15*b* is connected in the form of a cantilever, of the valve support piece 28, which is erected upward from the top plate portion 18*a* of the cap body portion 18, inside the outside air intake chamber 19 as illustrated in FIG. 4. Accordingly, since the valve portion 15*b* is rotatable about a portion thereof connected to the valve support piece 28 and can come into close contact with the lower end face of the cylindrical valve seat portion 15*a*, the intake valve mechanism 15 capable of opening and closing the outside air intake port 14 can be easily formed inside the outside air intake chamber 19.

Meanwhile, when the container body 11 is not pressed in this embodiment, the valve portion 15*b* is connected to the valve support piece 28 in the form of a cantilever in such a manner that a predetermined gap is formed between the lower end face of the cylindrical valve seat portion 15*a* and the valve portion 15*b* (FIG. 4). Further, when the container body 11 is pressed, the valve portion 15*b* is elastically deformed about the portion thereof connected to the valve support piece 28 due to an increase in the internal pressure of the container body, and, thereby, the valve portion 15*b* comes into close contact with the lower end face of the cylindrical valve seat portion 15*a*.

In this embodiment, it is preferable that the valve portion 15*b*, which moves according to the change in pressure, is provided so as to directly face the top plate portion-outside air intake port 27, and it is more preferable that an object hindering the flow of air is not provided between the valve portion 15*b* and the top plate portion-outside air intake port 27.

In the nozzle cap-equipped discharge container 10 of this embodiment having the above-mentioned structure, the body part 12*a* and the lid part 12*b* of the nozzle cap 12 are integrally molded while being opened as described above. While the body part 12*a* and the lid part 12*b* are opened, from the above, for example, three porous members 22 are stacked and mounted inside the longitudinal discharge flow passage 16 formed by the large-diameter cylinder section 21*a* of the two-stage cylindrical portion 21. After that, the lid part 12*b* is rotated about the hinge joint 12*c* so that the body part 12*a* and the lid part 12*b* are integrally joined to each other. Accordingly, an upper portion of the lower part 20*b* of a portion, which includes the discharge nozzle portion 13 and the outside air intake chamber 19, is closed by the upper part 20*a*, so that the discharge nozzle portion 13 and the outside air intake chamber 19 are formed, and the nozzle cap 12 in which the intake valve mechanism 15 including the cylindrical valve seat portion 15*a* and the valve portion 15*b* is provided inside the outside air intake chamber 19 is easily formed.

When the cap body portion 18 is mounted on the mouth neck section 11*a* in a state that the upper end portion of the dip tube 23 is mounted in the small-diameter cylinder section 21*b* of the two-stage cylindrical portion 21 provided in the cap body portion 18 of the nozzle cap 12, the formed nozzle cap 12 is mounted integrally with the container body 11. Accordingly, the nozzle cap-equipped discharge container 10 of this embodiment is formed.

Further, according to the nozzle cap-equipped discharge container 10 of this embodiment having the above-mentioned structure, the structure of the nozzle cap and a step of assembling the nozzle cap can be further simplified, and the container 10 can be formed to be more compact through the further reduction of the height of the nozzle cap protruding from the mouth neck section of the container body.

That is, according to this embodiment, the nozzle cap 12 has a two-part structure that includes the body part 12*a* and the lid part 12*b*. Accordingly, in a state that the lid part 12*b* is opened relative to the body part 12*a*, the porous members 22, which are to foam, for example, content liquid by work or an operation performed from above the longitudinal discharge flow passage 16, can be easily and smoothly mounted on the longitudinal discharge flow passage 16. Accordingly, unlike in the nozzle cap-equipped discharge container in the related art, the longitudinal discharge flow passage, which includes the porous members, the valve mechanism, and the like, does not need to be formed of a member separate from the nozzle cap and does not need to be assembled with the nozzle cap later, or the porous member, the valve mechanism, or the like does not need to be mounted on the longitudinal discharge flow passage by work or an operation performed from below the nozzle cap. For this reason, the longitudinal discharge flow passage can be easily formed integrally with the nozzle cap 12. Accordingly, the structure of the nozzle cap and a step of assembling the nozzle cap can be further simplified. Therefore, since the nozzle cap 12 can be formed in such a manner that the height of the nozzle cap 12 is further reduced, it is possible to easily make the container compact and to form the container at a lower cost by effectively reducing the number of parts to be used or the amount of a resin to be used.

In addition, when content liquid contained in the container body 11 is likely to be solidified by coming into contact with, for example, air, it is possible to easily remove solidified content liquid by cleaning the flow passage or the like for the content liquid in a state that the lid part 12*b* is opened relative to the body part 12*a*.

Moreover, in the case that the discharge section is the discharge nozzle portion 13 including the lateral discharge flow passage 17 as the tip-side discharge flow passage, the discharge nozzle portion 13 can be formed in such a manner that the tip discharge port 13*a* of the discharge nozzle portion 13 faces downward as illustrated in FIGS. 1 and 2. In the case that tip discharge port 13*a* is formed so as to face downward, content liquid can be discharged to the palm of the hand even though the container body 11 is pressed (squeezed) while being erected without being tilted. In the case that the nozzle cap does not have a two-part structure including the body part and the lid part, that is, when the nozzle cap is integrally molded, a hollow pipe provided with a downward tip discharge port is separately prepared and the hollow pipe needs to be inserted into a lateral discharge flow passage that is laterally oriented as in a container disclosed in, for example, WO2011/075640 due to limitations on the structure of a mold that is used to mold the nozzle cap.

In addition, according to the nozzle cap-equipped discharge container 10 of this embodiment, it is possible to easily form the intake valve mechanism 15, which opens and closes the outside air intake port 14, without using a valve member, which is separately formed as a separate part made of a material different from the resin material of the nozzle cap 12, by a simple structure and a simple assembling step in which the lid part 12*b* is integrally joined to the body part while being rotated and closed after the nozzle cap 12 is integrally molded in a state that the body part 12*a* and the lid part 12*b* are opened.

Further, according to the nozzle cap-equipped discharge container 10 of this embodiment having the above-mentioned structure, since the change of pressure in the container body 11 is instantly transmitted to the valve portion 15*b*, the responsiveness of the simple intake valve mechanism 15 including the valve portion 15*b* is further improved. As a result, it is possible to improve usability.

That is, according to the nozzle cap-equipped discharge container 10 of this embodiment, the valve mechanism 15, which opens and closes the outside air intake port 14, has a simple structure that includes the valve seat portion 15*a* provided on the inner surface of the outside air intake chamber 19 and the valve portion 15*b* capable of coming into close contact with the valve seat portion 15*a*; the outside air intake chamber 19 includes the annular partition 34 that partitions a periphery of the intake valve mechanism 15; and the annular partition 34 is provided so as to airtightly partition the outside air-intake flow passage, which extends from the outside air intake port 14 to the top plate portion-outside air intake port 27. Accordingly, it is possible to reliably avoid the leakage of air that is caused by an operation for grasping and pressing the container body 11 or releasing the pressing of the container body when air passes through the outside air-intake flow passage in which the intake valve mechanism 15 is disposed, to the outside of the annular partition 34. Therefore, since the change of pressure in the container body 11 is instantly transmitted to the valve portion 15*b*, the responsiveness of the valve mechanism can be effectively improved. As a result, it is possible to improve the ease of use of the nozzle cap-equipped discharge container 10.

Further, according to the nozzle cap-equipped discharge container 10 of this embodiment, the porous members 22 are mounted inside the longitudinal discharge flow passage 16 from above in a state that the body part 12*a* and the lid part 12*b* are opened; and the body part 12*a* and the lid part 12*b*, which are opened, are closed and integrally joined to each other, so that the intake valve mechanism 15 for opening and closing the outside air intake port 14 is formed. Accordingly, since the nozzle cap 12, which has a function as a squeeze foamer for foaming the content liquid and discharging the content liquid in the form of foam, can be formed so that the height of the nozzle cap 12 is further reduced, it is possible to easily make the container compact and to form the container at a lower cost by effectively reducing the number of parts to be used or the amount of a resin to be used.

Furthermore, according to the nozzle cap-equipped discharge container 10 of this embodiment having the above-mentioned structure, it is possible to make the nozzle cap 12 compact by reducing the height of the nozzle cap 12 and to foam content liquid while mixing the content liquid with air without the deterioration of the quality of foam.

That is, in this embodiment, the porous members 22 are stacked and mounted inside the longitudinal discharge flow passage 16 that is opened at the top plate portion 18*a* of the cap body portion 18 and is formed by the large-diameter cylinder section 21*a* of the two-stage cylindrical portion 21, and a gas-liquid mixing chamber is not formed below the porous members 22 of the longitudinal discharge flow passage 16. Accordingly, it is possible to make the nozzle cap 12 compact by reducing the height of the nozzle cap 12 through the reduction of the length of the longitudinal discharge flow passage 16.

Further, in this embodiment, when seen in the lateral direction, the tip portion of the liquid flow passage 24*a* and the tip portion of the air flow passages 24*b* are formed so as to have a positional relationship where the extension line X from the tip supply port 26*a* of the liquid flow passage 24*a* in the content liquid supply direction and the extension lines Y from the tip supply ports 26*b* of the air flow passages 24*b* in the air supply direction reach the lower surface of the porous member 22 before crossing each other. Accordingly, since the content liquid pumped from the tip supply port 26*a* of the liquid flow passage 24*a* and the air pumped from the tip supply ports 26*b* of the air flow passages 24*b* reach the lower surface of the lowermost molded mesh 22 before being mixed with each other, it is possible to form foam, which is fine and has high quality, by an effect in which turbulence such as eddies is generated due to the collision between each molded mesh and the air and the content liquid and the air and the content liquid are mixed with each other while causing turbulence when the air and the content liquid pass through each molded mesh 22 (each porous member 22).

Therefore, according to the nozzle cap-equipped discharge container 10 of this embodiment, even though a gas-liquid mixing chamber is not particularly formed or a gas-liquid mixing chamber is formed so as to have a small height, it is possible to foam the content liquid as fine foam while mixing the content liquid with air without the deterioration of the quality of foam.

The invention is not limited to the above-mentioned embodiment and may have various modifications. For example, the nozzle cap-equipped discharge container of the invention does not necessarily need to be a squeeze foamer container, and may be other squeeze containers such as squeeze-type double release containers, which discharge content liquid from a discharge nozzle portion when a container body is pressed (squeezed). Further, the nozzle cap-equipped discharge container of the invention does not necessarily need to be a squeeze container that discharges content liquid when a container body is pressed, and may be various other discharge containers such as pump containers having a function to discharge content liquid, which is fed when the inside of a container body is pressurized, from a discharge nozzle portion. In containers other than these squeeze foamer containers, other necessary components or members other than porous members are mounted in a longitudinal discharge flow passage from above the longitudinal discharge flow passage in a state that a body part and a lid part are opened. Accordingly, the same functions and effects as the squeeze foamer container are obtained.

Furthermore, the lid part does not necessarily need to form the upper part of a portion that includes a whole of the discharge nozzle portion, and may form the upper part of only a region, which includes a portion directly above the longitudinal discharge flow passage, of the discharge nozzle portion. The lid part does not necessarily need to be connected to the body part by the hinge joint, and may be molded as a part separate from the body part. Moreover, the outside air intake chamber may not be provided in the nozzle cap.

Further, the valve portion does not necessarily need to be connected to the body part in the form of a cantilever. For example, the valve portion may be a valve portion in which a plurality of through slits are formed radially from the center of a rubber plate to form a plurality of valve pieces. In this case, it is preferable that the valve portion is mounted in such a manner that the center of the rubber plate (an origin of the radial through slits) corresponds to the axial center of the cylindrical valve seat portion. Examples of a mounting method include a method of fixing the valve portion by pinching the valve portion between the body part and the lid part. Furthermore, a ball valve, which uses a spherical body made of a resin or the like, may also be used. In the ball valve, for example, a cylindrical body having an inner diameter larger than the outer diameter of the spherical body is provided instead of the valve support piece on the body part so as to be concentric with the outside air intake port, and inner diameters of portions near upper and lower openings of the cylindrical body are set to gradually become smaller than the outer diameter of the spherical body so that the spherical body is not separated from the cylindrical body to the outside. The spherical body is generally disposed at a lower portion of the cylindrical body due to gravity. However, the spherical body is moved in the longitudinal direction with an operation for pressing the container body or releasing the pressing of the container body, so that the outside air intake port is smoothly opened and closed. Meanwhile, it is preferable that dimensions of each of the spherical body or the cylindrical body are set in such a manner that the outside air is isolated from the inside of the container body when the spherical body comes into contact with the upper opening in the cylindrical body due to internal pressure through the pressing of the container body. On the other hand, it is preferable that dimensions of each of the spherical body or the cylindrical body are set in such a manner that the outside air is not isolated from the inside of the container body when the spherical body comes into contact with the lower opening in the cylindrical body through the release of the pressing of the container body.

In the nozzle cap-equipped discharge container of the invention, the lower surface of the porous member does not necessarily need to be disposed adjacent to the tip supply port of the liquid flow passage and the tip supply ports of the air flow passages, and a gap may be formed between the lower surface of the porous member and the tip supply port of the liquid flow passage and the tip supply port of the air flow passage. If the tip portion of the liquid flow passage and the tip portion of the air flow passages are formed so as to have a positional relationship where the extension line from the tip supply port of the liquid flow passage in the content liquid supply direction and the extension lines from the tip supply ports of the air flow passages in the air supply direction reach the lower surface of the porous member before crossing each other when seen in the lateral direction even when a gas-liquid mixing chamber is interposed between the lower surface of the porous member and the tip supply port of the liquid flow passage and the tip supply port of the air flow passage, this structure is included in the invention.

Figure 6:
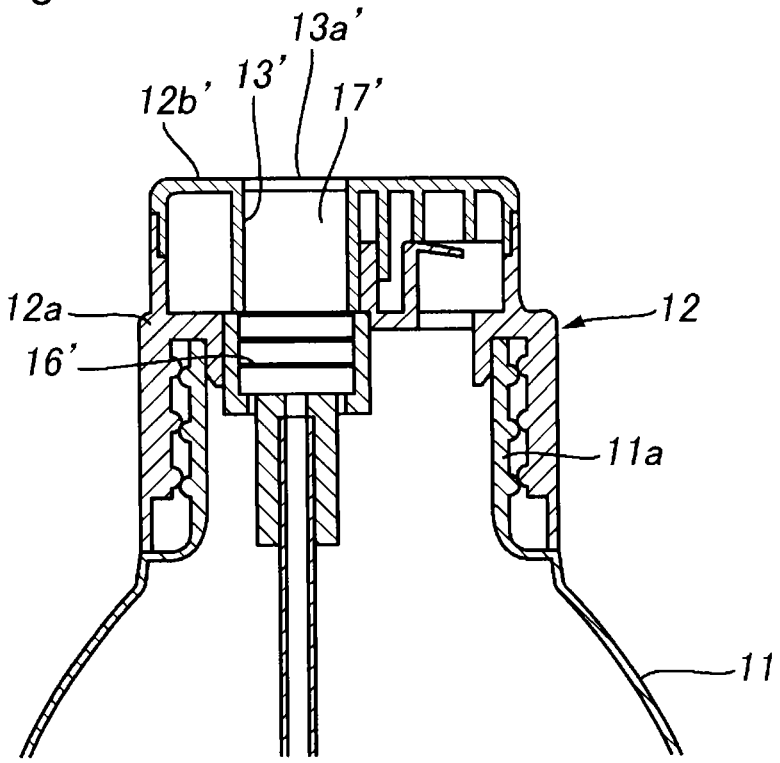
FIG. 6 is a cross-sectional view of main parts of a nozzle cap-equipped discharge container according to another embodiment.

The discharge section, which communicates with the longitudinal discharge flow passage and is provided with the tip-side discharge flow passage including the tip discharge port, does not necessarily need to be the discharge nozzle portion that includes the lateral discharge flow passage as the tip-side discharge flow passage. For example, as illustrated in FIG. 6, a discharge section 13' may include a longitudinal flow passage, which is formed so as to communicate with a longitudinal discharge flow passage 16' by using a lid part 12*b*' and is continued to an upper portion of the longitudinal discharge flow passage 16', as a tip-side discharge flow passage 17' that includes a tip discharge port 13*a*'. That is, the discharge nozzle portion may be formed of the tip-side discharge flow passage 17'. Further, a hollow pipe (not illustrated) may be inserted into the tip-side discharge flow passage 17', and the discharge nozzle portion may be formed of the tip-side discharge flow passage 17' and the hollow pipe. It is preferable that the outer diameter of the hollow pipe is substantially equal to the inner diameter of the tip-side discharge flow passage 17'. Furthermore, the inner diameter of the hollow pipe may be reduced toward a discharge tip portion, and a whole of the hollow pipe may be formed in an L shape (an elbow shape).

Moreover, a whole of the tip-side discharge flow passage does not need to have a two-part structure that includes a body part and a lid part. For example, a part of the tip-side discharge flow passage may be formed of only a lid part, and the tip-side discharge flow passage may be formed of three or more parts through the addition of a separate member.

In regards to the respective embodiments having been described above, the invention further discloses the following nozzle cap-equipped discharge container.

<1> A nozzle cap-equipped discharge container including:

a container body that is to contain content liquid; and a nozzle cap that is mounted on a mouth neck section of the container body and includes a discharge section discharging the content liquid fed by the pressurization of the inside of the container body, wherein the nozzle cap includes a longitudinal discharge flow passage that sends upward the content liquid fed from the container body, and a tip-side discharge flow passage that allows the longitudinal discharge flow passage and the discharge section to communicate with each other, and the nozzle cap includes a body part and a lid part, the body part includes the longitudinal discharge flow passage therein, the lid part forms the upper part of a region including a portion directly above the longitudinal discharge flow passage, and the tip-side discharge flow passage includes a flow passage that is formed by the body part and the lid part.

<2> The nozzle cap-equipped discharge container as set forth in clause <1>, wherein preferably, the discharge section is a discharge nozzle portion that includes a lateral discharge flow passage as the tip-side discharge flow passage.

<3> The nozzle cap-equipped discharge container as set forth in clause <2>, wherein preferably, the lid part forms the upper part of a portion including a whole of the discharge nozzle portion.

<4> The nozzle cap-equipped discharge container as set forth in clause <3>, wherein preferably, the lid part is connected to the body part by a hinge joint, and the lid part is rotated about the hinge joint after the lid part is molded integrally with the body part while being opened, so that the lid part is integrally joined to the body part in such a manner that the lid part closes an upper portion of a portion including a whole of the discharge nozzle portion.

<5> The nozzle cap-equipped discharge container as set forth in any one of clauses <1> to <4>, wherein preferably, the nozzle cap has a function as a squeeze foamer that, with pressing the container body, foams the content liquid while mixing the content liquid with air and discharges the content liquid from the discharge section in the form of foam.

<6> The nozzle cap-equipped discharge container as set forth in clause <5>, wherein preferably, a porous member for foaming the content liquid is mounted in the longitudinal discharge flow passage, and the porous member is mounted from above the longitudinal discharge flow passage in a state that the lid part and the body part are not integrally joined to each other and the lid part is opened.

<7> The nozzle cap-equipped discharge container as set forth in any one of clauses <1> to <6>, wherein preferably, an upper end portion of the longitudinal discharge flow passage and a top surface plate of the body part are formed flush with each other.

<8> The nozzle cap-equipped discharge container as set forth in clause <7>, wherein preferably, the discharge section is formed integrally with the top surface plate so as to protrude from the top surface plate of the body part.

<9> The nozzle cap-equipped discharge container as set forth in clause <7>, wherein preferably, the discharge section is a discharge nozzle portion that includes a lateral discharge flow passage as the tip-side discharge flow passage.

<10> The nozzle cap-equipped discharge container as set forth in any one of clauses <6> to <9>, wherein preferably, the lid part is integrally provided with a pressing wall that is disposed in an upper end opening of the longitudinal discharge flow passage of the body part and that is positioned directly above an outer peripheral edge portion of the porous member mounted inside the longitudinal discharge flow passage.

<11> The nozzle cap-equipped discharge container as set forth in any one of clauses <1> to <10>, wherein preferably, the discharge section is formed of the discharge nozzle portion that includes a lateral discharge flow passage as the tip-side discharge flow passage, and the lid part is integrally provided with a butting wall, which is disposed at an end portion located opposite to a tip discharge port of the lateral discharge flow passage, at a corner where the lateral discharge flow passage and the longitudinal discharge flow passage communicate with each other.

<12> The nozzle cap-equipped discharge container as set forth in clause <11>, wherein preferably, an inner surface of the butting wall has a curved shape.

<13> The nozzle cap-equipped discharge container as set forth in clause <11>, wherein preferably, the butting wall has a shape in which a notch or a slit is formed at a part of a side surface of a pipe.

<14> The nozzle cap-equipped discharge container as set forth in any one of clauses <1> to <13>, wherein preferably, the longitudinal discharge flow passage includes a two-stage cylindrical portion.

<15> The nozzle cap-equipped discharge container as set forth in clause <14>, wherein preferably, the two-stage cylindrical portion includes a large-diameter cylinder section located on an upper side and a small-diameter cylinder section located on a lower side.

<16> The nozzle cap-equipped discharge container as set forth in clause <15>, wherein preferably, an upper end portion of a dip tube, which extends to a bottom part of the container body, is mounted on the small-diameter cylinder section of the two-stage cylindrical portion.

<17> The nozzle cap-equipped discharge container as set forth in clause <15>, wherein preferably, an annular flange is formed at a stepped portion between the large-diameter cylinder section and the small-diameter cylinder section, and a plurality of air holes are formed in the annular flange at intervals in a circumferential direction so as to pass through the annular flange in a longitudinal direction.

<18> The nozzle cap-equipped discharge container as set forth in any one of clauses <7> to <9>, wherein preferably, the discharge section includes a lower nozzle part that includes the top surface plate of the body part as a bottom surface and includes side walls erected from the top surface plate.

<19> The nozzle cap-equipped discharge container as set forth in any one of clauses <7> to <9>, wherein preferably, the discharge section includes a lower nozzle part having a shape of which an upper side is opened.

<20> The nozzle cap-equipped discharge container as set forth in clause <2>, wherein preferably, the discharge nozzle portion including the lateral discharge flow passage is formed in such a manner that a tip discharge port thereof faces downward.

<21> The nozzle cap-equipped discharge container as set forth in any one of clauses <1> to <20>, wherein preferably, the nozzle cap includes an outside air intake port which is openable by an intake valve mechanism and through which outside air is taken into the container body when negative pressure is generated in the container body, the outside air intake port being opened at an outer peripheral surface of the nozzle cap at a region which is located outside the longitudinal discharge flow passage, the lid part forms the upper part of a portion including the region at which the outside air intake port is opened, and the intake valve mechanism includes a cylindrical valve seat portion that protrudes from an inner surface of the lid part so as to surround the outside air intake port, and a valve portion that is provided on the body part and that may come into close contact with a lower end face of the cylindrical valve seat portion.

<22> The nozzle cap-equipped discharge container as set forth in clause <21>, wherein preferably, the lid part forms the upper part of a portion that includes the discharge section and the region at which the outside air intake port is opened.

<23> The nozzle cap-equipped discharge container as set forth in clause <22>, wherein preferably, the lid part is connected to the body part by a hinge joint, and the lid part is rotated about the hinge joint after the lid part is molded integrally with the body part while being opened, so that the lid part is integrally joined to the body part in such a manner that the lid part closes an upper portion of a portion including the discharge section and the region at which the outside air intake port is opened.

<24> The nozzle cap-equipped discharge container as set forth in any one of clauses <1> to <20>, wherein preferably, an outside air intake chamber is disposed above the top surface plate of the cap body portion of the nozzle cap, the nozzle cap includes the outside air intake port which is openable by an intake valve mechanism provided in the outside air intake chamber and through which outside air is taken into the container body when negative pressure is generated in the container body, the outside air intake port being opened at an upper surface portion of the outside air intake chamber, the intake valve mechanism includes a valve seat portion that is provided on an inner surface of the outside air intake chamber so as to surround the outside air intake port, and a valve portion that may come into close contact with the valve seat portion, the outside air intake chamber includes an annular partition that partitions a periphery of the intake valve mechanism, and an upper end portion of the annular partition is joined to the upper surface portion of the outside air intake chamber and a lower end portion of the annular partition is joined to the top surface plate of the cap body portion, so that the annular partition is provided so as to airtightly partition an outside air-intake flow passage which extends from the outside air intake port to a top plate-outside air intake port, which is opened at the top surface plate.

<25> The nozzle cap-equipped discharge container as set forth in clause <24>, wherein preferably, the lid part forms the upper part of a portion that includes the outside air intake chamber, the annular partition includes a lid-side annular partition that protrudes from an inner surface of the lid part so as to surround the valve seat portion, and a body-side annular partition that is provided on the body part so as to surround the top plate-outside air intake port and be erected from the top surface plate of the cap body portion, and when the body part and the lid part are integrally joined to each other, a lower end portion of the lid-side annular partition and an upper end portion of the body-side annular partition come into close contact with each other, so that the annular partition is provided so as to airtightly partition the outside air-intake flow passage.

<26> The nozzle cap-equipped discharge container as set forth in clause <25>, wherein preferably, the lid part forms the upper part of a portion that includes the discharge section and the outside air intake chamber.

<27> The nozzle cap-equipped discharge container as set forth in clause <26>, wherein preferably, the lid part is connected to the body part by a hinge joint, and the lid part is rotated about the hinge joint after the lid part is molded integrally with the body part while being opened, so that the lid part is integrally joined to the body part in such a manner that the lid part closes an upper portion of a portion including the discharge section and the outside air intake chamber.

<28> The nozzle cap-equipped discharge container as set forth in any one of clauses <24> to <27>, wherein preferably, the valve seat portion of the intake valve mechanism is the cylindrical valve seat portion that protrudes from an inner surface of the lid part so as to surround the outside air intake port.

<29> The nozzle cap-equipped discharge container as set forth in any one of clauses <24> to <28>, wherein preferably, the valve portion of the intake valve mechanism is connected to a valve support portion, which is erected from the top surface plate of the cap body portion, in the form of a cantilever so as to be rotatable at a position corresponding to the valve seat portion.

<30> The nozzle cap-equipped discharge container as set forth in any one of clauses <5> to <29>, wherein preferably, the porous member, which is to foam the content liquid, is mounted inside the longitudinal discharge flow passage that is provided in the nozzle cap and sends the content liquid mixed with air to the discharge section, a tip supply port of a liquid flow passage, to which the content liquid is pumped and supplied from the container body, and a tip supply port of an air flow passage, to which air is pumped and supplied from the container body, are opened at an inner surface of a portion of the longitudinal discharge flow passage that is positioned below the porous member, and when seen in a lateral direction, a tip portion of the liquid flow passage and a tip portion of the air flow passage are formed so as to have a positional relationship where an extension line from the tip supply port of the liquid flow passage in a content liquid supply direction and an extension line from the tip supply port of the air flow passage in an air supply direction reach a lower surface of the porous member before crossing each other.

<31> The nozzle cap-equipped discharge container as set forth in clause <30>, wherein preferably, the lower surface of the porous member is disposed adjacent to the tip supply port of the liquid flow passage and the tip supply port of the air flow passage.

<32> The nozzle cap-equipped discharge container as set forth in clause <30> or <31>, wherein preferably, a plurality of the porous members are stacked and mounted inside the longitudinal discharge flow passage, and when seen in the lateral direction, the tip portion of the liquid flow passage and the tip portion of the air flow passage are formed so as to have a positional relationship where the extension line from the tip supply port in the content liquid supply direction and the extension line from the tip supply port in the air supply direction reach a lower surface of the lowermost porous member before crossing each other.

Industrial Applicability

According to the nozzle cap-equipped discharge container of the invention, the structure of the nozzle cap and a step of assembling the nozzle cap can be further simplified and the container can be formed to be compact through the further reduction of the height of the nozzle cap protruding from the mouth neck section of the container body.

According to the nozzle cap-equipped discharge container of the invention, the valve mechanism for opening and closing the outside air intake port can be easily formed by a simple structure and a simple assembling step.

According to the nozzle cap-equipped discharge container of the invention, the change of pressure in the container body is allowed to be instantly transmitted to the valve portion to further improve the responsiveness of the valve mechanism including the valve portion so that usability can be improved.

According to the nozzle cap-equipped discharge container of the invention, even though a gas-liquid mixing chamber is not particularly formed or a gas-liquid mixing chamber is formed so as to have a small height, it is possible to foam content liquid while mixing the content liquid with air without the deterioration of the quality of foam.

The invention claimed is:

1. A nozzle cap-equipped discharge container comprising:

a container body that is to contain content liquid; and a nozzle cap that is mounted on a mouth neck section of the container body and includes a discharge section discharging the content liquid fed by the pressurization of the inside of the container body, wherein the nozzle cap includes a longitudinal discharge flow passage that sends upward the content liquid fed from the container body, and a tip-side discharge flow passage that allows the longitudinal discharge flow passage and the discharge section to communicate with each other, and the nozzle cap includes a body part and a lid part, the body part includes the longitudinal discharge flow passage therein, the lid part forms an upper part of a region including a portion directly above the longitudinal discharge flow passage, and the tip-side discharge flow passage includes a flow passage that is formed by the body part and the lid part, the nozzle cap has a function as a squeeze foamer that, with pressing the container body, foams the content liquid while mixing the content liquid with air, and discharges the content liquid from the discharge section in the form of foam, a porous member for foaming the content liquid is mounted inside the longitudinal discharge flow passage, the porous member is mounted from above the longitudinal discharge flow passage in a state that the lid part and the body part are not integrally joined to each other and the lid part is opened, and the lid part is integrally provided with a pressing wall that is disposed in an upper end opening of the longitudinal discharge flow passage of the body part and that is positioned directly above an outer peripheral edge portion of the porous member mounted inside the longitudinal discharge flow passage.

2. The nozzle cap-equipped discharge container according to claim 1, wherein the discharge section is a discharge nozzle portion that includes a lateral discharge flow passage as the tip-side discharge flow passage.

3. The nozzle cap-equipped discharge container according to claim 2, wherein the lid part forms the upper part of a portion including a whole of the discharge nozzle portion.

4. The nozzle cap-equipped discharge container according to claim 3, wherein the lid part is connected to the body part by a hinge joint, and the lid part is rotated about the hinge joint after the lid part is molded integrally with the body part while being opened, so that the lid part is integrally joined to the body part in such a manner that the lid part closes an upper portion of a portion including a whole of the discharge nozzle portion.

5. The nozzle cap-equipped discharge container according to claim 1, wherein an upper end portion of the longitudinal discharge flow passage and a top surface plate of the body part are formed flush with each other.

6. The nozzle cap-equipped discharge container according to claim 5, wherein the discharge section is formed integrally with the top surface plate so as to protrude from the top surface plate of the body part.

7. The nozzle cap-equipped discharge container according to claim 5, wherein the discharge section is a discharge nozzle portion that includes a lateral discharge flow passage as the tip-side discharge flow passage.

8. The nozzle cap-equipped discharge container according to claim 2, wherein the discharge section is formed of the discharge nozzle portion that includes a lateral discharge flow passage as the tip-side discharge flow passage, and the lid part is integrally provided with a butting wall, which is disposed at an end portion located opposite to a tip discharge port of the lateral discharge flow passage, at a corner where the lateral discharge flow passage and the longitudinal discharge flow passage communicate with each other.

9. The nozzle cap-equipped discharge container according to claim 8, wherein an inner surface of the butting wall has a curved shape.

10. The nozzle cap-equipped discharge container according to claim 8, wherein the butting wall has a shape in which a notch or a slit is formed at a part of a side surface of a pipe.

11. The nozzle cap-equipped discharge container according to claim 1, wherein the longitudinal discharge flow passage includes a two-stage cylindrical portion.

12. The nozzle cap-equipped discharge container according to claim 11, wherein the two-stage cylindrical portion includes a large-diameter cylinder section located on an upper side and a small-diameter cylinder section located on a lower side.

13. The nozzle cap-equipped discharge container according to claim 12, wherein an upper end portion of a dip tube, which extends to a bottom part of the container body, is mounted on the small-diameter cylinder section of the two-stage cylindrical portion.

14. The nozzle cap-equipped discharge container according to claim 12, wherein an annular flange is formed at a stepped portion between the large-diameter cylinder section and the small-diameter cylinder section, and a plurality of air holes are formed in the annular flange at intervals in a circumferential direction so as to pass through the annular flange in a vertical direction.

15. The nozzle cap-equipped discharge container according to claim 5, wherein the discharge section includes a lower nozzle part that includes the top surface plate of the body part as a bottom surface and includes side walls erected from the top surface plate.

16. The nozzle cap-equipped discharge container according to claim 5, wherein the discharge section includes a lower nozzle part having a shape of which an upper side is opened.

17. The nozzle cap-equipped discharge container according to claim 2, wherein the discharge nozzle portion including the lateral discharge flow passage is formed in such a manner that a tip discharge port thereof faces downward.

18. The nozzle cap-equipped discharge container according to claim 1, wherein the nozzle cap includes an outside air intake port which is openable by an intake valve mechanism and through which outside air is taken into the container body when negative pressure is generated in the container body, the outside air intake port being opened at an outer peripheral surface of the nozzle cap at a region which is located outside the longitudinal discharge flow passage, the lid part forms the upper part of a portion including the region at which the outside air intake port is opened, and the intake valve mechanism includes: a cylindrical valve seat portion that protrudes from an inner surface of the lid part so as to surround the outside air intake port; and a valve portion that is provided on the body part and that may come into close contact with a lower end face of the cylindrical valve seat portion.

19. The nozzle cap-equipped discharge container according to claim 18, wherein the lid part forms the upper part of a portion that includes the discharge section and the region at which the outside air intake port is opened.

20. The nozzle cap-equipped discharge container according to claim 19, wherein the lid part is connected to the body part by a hinge joint, and the lid part is rotated about the hinge joint after the lid part is molded integrally with the body part while being opened, so that the lid part is integrally joined to the body part in such a manner that the lid part closes an upper portion of a portion including the discharge section and the region at which the outside air intake port is opened.

21. The nozzle cap-equipped discharge container according to claim 5, wherein an outside air intake chamber is disposed above the top surface plate of the cap body part of the nozzle cap, the nozzle cap includes an outside air intake port which is openable by an intake valve mechanism provided in the outside air intake chamber and through which outside air is taken into the container body when negative pressure is generated in the container body, the outside air intake port being opened at an upper surface portion of the outside air intake chamber, the intake valve mechanism includes: a valve seat portion that is provided on an inner surface of the outside air intake chamber so as to surround the outside air intake port; and a valve portion that may come into close contact with the valve seat portion, the outside air intake chamber includes an annular partition that partitions a periphery of the intake valve mechanism, and an upper end portion of the annular partition is joined to the upper surface portion of the outside air intake chamber and a lower end portion of the annular partition is joined to the top surface plate of the cap body part, so that the annular partition is provided so as to airtightly partition an outside air-intake flow passage which extends from the outside air intake port to a top plate-outside air intake port which is opened at the top surface plate.

22. The nozzle cap-equipped discharge container according to claim 21, wherein the lid part forms the upper part of a portion that includes the outside air intake chamber, the annular partition includes: a lid-side annular partition that protrudes from an inner surface of the lid part so as to surround the valve seat portion; and a body-side annular partition that is provided on the body part so as to surround the top plate-outside air intake port and be erected from the top surface plate of the cap body part, and when the body part and the lid part are integrally joined to each other, a lower end portion of the lid-side annular partition and an upper end portion of the body-side annular partition come into close contact with each other, so that the annular partition is provided so as to airtightly partition the outside air-intake flow passage.

23. The nozzle cap-equipped discharge container according to claim 22, wherein the lid part forms the upper part of a portion that includes the discharge section and the outside air intake chamber.

24. The nozzle cap-equipped discharge container according to claim 23, wherein the lid part is connected to the body part by a hinge joint, and the lid part is rotated about the hinge joint after the lid part is molded integrally with the body part while being opened, so that the lid part is integrally joined to the body part in such a manner that the lid part closes an upper portion of a portion including the discharge section and the outside air intake chamber.

25. The nozzle cap-equipped discharge container according to 21, wherein the valve seat portion of the intake valve mechanism is a cylindrical valve seat portion that protrudes from an inner surface of the lid part so as to surround the outside air intake port.

26. The nozzle cap-equipped discharge container according to claim 21, wherein the valve portion of the intake valve mechanism is connected to a valve support portion, which is erected from the top surface plate of the cap body portion, in the form of a cantilever so as to be rotatable at a position corresponding to the valve seat portion.

27. The nozzle cap-equipped discharge container according to claim 1, wherein the porous member, which is to foam the content liquid, is mounted inside the longitudinal discharge flow passage that is provided in the nozzle cap and sends the content liquid mixed with air to the discharge section, a tip supply port of a liquid flow passage, to which the content liquid is pumped and supplied from the container body, and a tip supply port of an air flow passage, to which air is pumped and supplied from the container body, are opened at an inner surface of a portion of the longitudinal discharge flow passage that is positioned below the porous member, and when seen in a horizontal direction, a tip portion of the liquid flow passage and a tip portion of the air flow passage are formed so as to have a positional relationship where an extension line from the tip supply port of the liquid flow passage in a content liquid supply direction and an extension line from the tip supply port of the air flow passage in an air supply direction reach a lower surface of the porous member before crossing each other.

28. The nozzle cap-equipped discharge container according to claim 27, wherein the lower surface of the porous member is disposed adjacent to the tip supply port of the liquid flow passage and the tip supply port of the air flow passage.

29. The nozzle cap-equipped discharge container according to claim 27, wherein a plurality of the porous members are stacked and mounted inside the longitudinal discharge flow passage, and when seen from the horizontal direction, the tip portion of the liquid flow passage and the tip portion of the air flow passage are formed so as to have a positional relationship where the extension line from the tip supply port in the content liquid supply direction and the extension line from the tip supply port in the air supply direction reach a lower surface of the lowermost porous member before crossing each other.

* * * * *